US006197724B1

(12) United States Patent
Aono

(10) Patent No.: US 6,197,724 B1
(45) Date of Patent: Mar. 6, 2001

(54) HEAT-SENSITIVE RECORDING MATERIAL

(75) Inventor: Toshiaki Aono, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/252,815

(22) Filed: Feb. 19, 1999

(30) Foreign Application Priority Data

Mar. 9, 1998 (JP) ..... 10-057256

(51) Int. Cl.[7] ..... B41M 5/28
(52) U.S. Cl. ..... 503/209; 503/204; 503/215
(58) Field of Search ..... 503/204, 208, 503/209, 215–217

(56) References Cited

FOREIGN PATENT DOCUMENTS

| | | |
|---|---|---|
| 0 436 390 | 7/1991 | (EP) . |
| 0 587 139 | 3/1994 | (EP) . |
| 0 688 680 | 12/1995 | (EP) . |
| 2 178 183 | 2/1987 | (GB) . |
| 1-224056 | 9/1989 | (JP) . |
| 7-219113 | 8/1995 | (JP) . |

*Primary Examiner*—Bruce H. Hess

(74) *Attorney, Agent, or Firm*—Sughrue, Mion, Zinn, Macpeak & Seas, PLLC

(57) ABSTRACT

A heat-sensitive recording material in which dispersion stability of a color-developing compound or a film improving compound contained in the heat-sensitive recording material can be improved, and images which have uniform image quality and which are excellent in transparency, glossiness, and light-fastness can be formed with high color-developing sensitivity.

There is provided a heat-sensitive recording material comprising a support, a heat-sensitive recording layer which is provided on the support and contains at least two types of compounds which react with each other so as to develop color by heating imagewise, and a protective layer in this order, wherein at least one of the layers contains the compound represented by the following formula (I). This compound is preferably contained in the same layer which contains a microcapsule or a latex:

$$R—(S—P)_n \qquad (I)$$

wherein R represents a hydrophobic group or a hydrophobic polymer, P represents a polymer including at least one of structural units A, B, and C as further defined herein, and having a polymerization degree which ranges from 10 to 3500, and n represents 1 or 2.

7 Claims, No Drawings

HEAT-SENSITIVE RECORDING MATERIAL

BACKGROUND OF THE INVENTION

1. Field of the Invention

The present invention relates to a heat-sensitive recording material, and particularly to a heat-sensitive recording material which comprises a support, a heat-sensitive recording layer which is provided on the support and contains at least two types of compounds which react with each other by heating imagewise to thereby develop color, and a protective layer, in which the heat-sensitive recording material has good film quality and is excellent in transparency, glossiness, and light-fastness, and images can be written and recorded by a thermal head or an infrared laser with high color-developing sensitivity.

2. Description of the Related Art

Heat-sensitive recording has been recently developing because the device used for the heat-sensitive recording is structured simply, is highly reliable, and does not need complicated maintenance. As a heat-sensitive recording material, conventionally, compound obtained through the reaction of an electron donative colorless dye and an electron acceptive compound, and compound obtained through the reaction of a diazonium salt compound and a coupler are widely known.

In recent years, in order to improve properties including (1) color developing density and color developing sensitivity, (2) fastness of color developer and the like in heat-sensitive recording materials, extensive studies have been carried out. However, when a heat-sensitive recording material is exposed to sunlight or displayed on walls at offices or the like for a long period of time, there have been drawbacks in that background portions of the material become colored through irradiation of light, and image areas may become discolored or faded. In order to improve the discoloring or fading of image areas, various methods have been proposed. However, these methods fail to sufficiently provide the above-described improvements.

On the other hand, in multiple fields such as facsimiles, printers, labels, and the like, demands for a heat-sensitive recording system are increasing. Therefore, it is becoming necessary for heat-sensitive recording paper on which images are written by a heat-sensitive recording head or an infrared laser through imagewise heating to provide higher degrees of writing sensitivity or image quality. At this point, conventionally, in order to provide a heat-sensitive recording material with color-developing sensitivity and light-fastness, as well as film quality at the same time, one of the two types of compound which react with each other through the application of heat has been encapsulated in a microcapsule so as not to perform mutual reaction and color-developing during storage. However, the microcapsules may tend to aggregate as time elapses during the preparation of the solution and the application thereof. Accordingly, it has been difficult to obtain a uniform and high quality image through homogeneous dispersion of the capsule solution. Further, when the other compound which performs the color-developing reaction is mixed as an emulsion, or when a latex dispersion solution is added to the microcapsule in order to improve the film quality of the heat-sensitive recording material, aggregation of the microcapsules has been increasing.

A hydrophobic compound is dissolved in oil or the like, and the resultant solution is added to a coating solution as an emulsion and used, however, separation or composition may occur during dissolving or refrigerating processes, and image quality often deteriorates.

Further, in order to improve the durability of the heat-sensitive recording material, a layer which contains a capsule containing an ultraviolet absorbent precursor has been provided at the outermost layer of the heat-sensitive recording material as a light transmittance adjusting layer. However, even in this case, microcapsule aggregation occurs, which triggers a manufacturing disorder of the heat-sensitive recording material. In this way, it has been desired to provide a heat-sensitive recording material which prevents microcapsule or latex aggregation which is contained in each of the layers of the heat-sensitive recording material, and thereby obtains a high quality image having a uniform hue in each of the layers by uniformly dispersing a capsule dispersion solution or a latex dispersion solution. However, in spite of the layered structure of a protective layer, a heat-sensitive recording layer, and the like, there has been a large problem that, when solid matter or an emulsified dispersion of latex or the like and a microcapsule dispersion solution coexist in the same layer, microcapsules aggregate extremely easily.

SUMMARY OF THE INVENTION

It is an object of the present invention to provide a heat-sensitive recording material which can improve the dispersion stability of a color developing compound or a film quality improving compound contained therein and on which images having uniform image quality, excellent transparency and glossiness can be formed with high color-developing sensitivity, using a thermal head or an infrared laser, through imagewise heating.

It is another object of the present invention to provide a heat-sensitive recording material which prevents aggregation of microcapsule or emulsion which contain therein a color-developing compound, or prevents aggregation of a latex in a latex dispersion solution which is added in order to improve film quality of a heat-sensitive recording material (e.g., to prevent a bubble opacity defects which are caused when nitrogen gas, which is generated by a diazo compound photodecomposing, swells due to the heat generated during printing) so that an image having homogeneous image quality, excellent transparency and glossiness can be formed with a high degree of sensitivity.

To accomplish the aforementioned objects, the inventors of the present invention carried out extensive studies, and found that known polymers as additives to photographing elements are useful as dispersing agents of emulsion and latex provide very good results, thus achieving the present invention.

Namely, a heat-sensitive recording material according to the present invention comprises in sequence a support, a heat-sensitive recording layer which is provided on this support and contains at least two types of compound which react with each other by heating imagewise so as to develop color, and a protective layer, wherein at least one of the layers contains a compound represented by the formula (I), $$R—(S—P)_n \qquad (I)$$

wherein R represents a hydrophobic group or a hydrophobic polymer, P represents a polymer which includes at least one of the structural units A, B and C described below, and whose polymerization degree is more than or equal to 10 and less than or equal to 3500, and n represents 1 or 2;

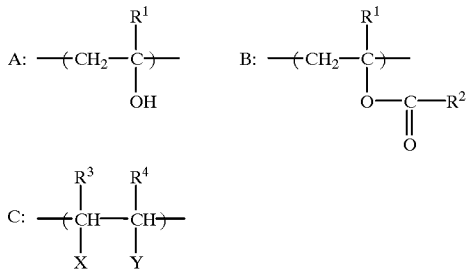

wherein $R^1$ represents —H or an alkyl group having 1 to 6 carbon atoms, $R^2$ represents —H or an alkyl group having 1 to 10 carbon atoms, $R^3$ represents —H or —$CH_3$, $R^4$ represents H, —$CH_3$, —$CH_2COOH$ (including ammonium salt or metallic salt) or —CN, X represents —H, —COOH (including ammonium salt or metallic salt) or —$CONH_2$, and Y represents —COOH (including ammonium salt or metallic salt), —$SO_3H$ (including ammonium salt or metallic salt), —$OSO_3H$ (including ammonium salt or metallic salt), —$CH_2SO_3H$ (including ammonium salt or metallic salt), —$CONHC(CH_3)_2CH_2SO_3H$ (including ammonium salt or metallic salt) or —$CONHCH_2CH_2CH_2N^+(CH_3)_3Cl_-$.

In accordance with a second aspect of the present invention, there is provided a heat-sensitive recording material, wherein at least one of the types of compound which react with each other through the application of heat to thereby develop color is encapsulated in a microcapsule, and at least the layer containing the microcapsule contains the compound represented by the formula (I).

In accordance with a third aspect of the present invention, there is provided a heat-sensitive recording material in which at least one of the heat-sensitive recording layer and the layers adjacent to the heat-sensitive recording layer contains a latex which is dispersed and stabilized by the compound represented by the formula (I).

In these heat-sensitive recording materials, as two types of compound which react with each other by heating imagewise to thereby develop color, a diazo compound and a coupler which reacts with the diazo compound to thereby develop color are used in combination, or an electron donative dye precursor and an electron acceptive compound are used in combination. In the combination of a diazo compound and a coupler, the diazo compound is preferably encapsulated in a microcapsule. In the combination of an electron donative dye precursor and an electron acceptive compound, either one of them is preferably encapsulated in a microcapsule.

The heat-sensitive recording material according to the present invention may comprise a heat-sensitive recording layer which contains an electron donative dye precursor and an electron acceptive compound, a heat-sensitive recording layer which contains a diazonium salt compound and a coupler, or a plurality of these heat-sensitive recording layers in which the aforementioned heat-sensitive recording layers are used in combination.

Ordinarily, a heat-sensitive recording material forms an image by heating imagewise, using a heat-sensitive head. However, it is known that this type of heat-sensitive head deteriorates because of the presence of Na-ions or K-ions. In the present invention, coating performance can be improved by adding the compound represented by the formula (I) to the heat-sensitive recording layer. Accordingly, sufficient coating properties can be obtained without using an anionic surfactant which is a low molecular compound containing the aforementioned Na-ions or the like and which is used as a coating assistant for a heat-sensitive recording layer coating solution, or by adding a small amount of the anionic surfactant.

Further, in the present invention, it is possible to greatly improve glossiness by adding the compound represented by the formula (I). This action is not apparent but this compound has the functions of suppressing separation of a water-soluble (semi-water-soluble) compound into a heat-sensitive recording layer, of preventing aggregation of a dispersing substance in a coating solution, and of suppressing the oozing of oil compounds in emulsion to the surface of the layer. Further, because a homogeneous heat-sensitive recording layer can be formed due to the above-described improvement in the coating suitability, it can be considered that this compound contributes to the improvement in the glossiness.

DETAILED DESCRIPTION OF THE PREFERRED EMBODIMENTS

A description of a preferred embodiment of a heat-sensitive recording material according to the present invention will be given hereinafter.

A heat-sensitive recording material according to the present invention comprises in sequence a support, a heat sensitive recording layer which is provided on the support and contains at least two types of compound which react with each other by heating imagewise so as to develop color, and a protective layer, wherein at least one of the types of compound which react with each other by heating imagewise is encapsulated in a microcapsule, and the layer having the microcapsule contains a compound represented by the formula (I). Further, according to another aspect of the present invention, at least one of the heat-sensitive recording layer and the layers adjacent to this heat-sensitive recording layer contains a latex which is dispersed and stabilized by the compound represented by the formula (I).

In the above-described formula (I), R represents a hydrophobic group or a hydrophobic polymer, P represents a polymer including at least one of the structural units A, B and C as described above and having a polymerization degree which ranges from 10 to 350, and n represents 1 or 2.

$R^1$ represents —H or an alkyl group having 1 to 6 carbon atoms, $R^2$ represents —H or an alkyl group having 1 to 10 carbon atoms, $R^3$ represents —H or —$CH_3$, $R^4$ represents —H, —$CH_3$, —$CH_2COOH$, or —CN, X represents —H, —COOH, or —$CONH_2$, and Y represents —COOH, —$SO_3H$, —$OSO_3H$, —$CH_2SO_3H$, —CONH—$C(CH_3)_2$ $CH_2SO_3H$, or —$CONHCH_2CH_2CH_2N+(CH_3)_3CV$—. However, the —COOH group or —$SO_3H$ group contained in these structural units may be substituted by ammonium salt or metallic salt.

At this point, x, y, and z mol % of the contents of the above-described structural units A, B, and C are preferably $x+y+z=100$, $0 \leqq x \leqq 100$, $0 \leqq y \leqq 75$, and $0 \leqq z \leqq 100$, and more preferably $x+y+z=100$, $0 \leqq x \leqq 100$, $0 \leqq y \leqq 50$, and $0 \leqq z \leqq 50$.

The polymerization degree of the aforementioned polymer P preferably ranges from 10 to 500, and more preferably, from 50 to 300. If the polymerization degree of polymer P is less than 10, the polymer has insufficient water-solubility. If the polymerization degree is more than 500, the effect of the present invention is deteriorated. Therefore, neither of these are acceptable.

Examples of hydrophobic groups of R in the formula (I) include substituted or unsubstituted groups such as an aliphatic group (e.g., an alkyl group, an alkenyl group, an alkynyl group or the like), an aromatic group (e.g., a phenyl group, a naphthyl group or the like), and an alicyclic group. Examples of substituent groups include an aliphatic group, an aromatic group, an alicyclic group, a heterocyclic group, halogen atoms, a hydroxyl group, a cyano group, a nitro group, an N-substituted sulfamoyl group, a carbamoyl group, an acylamino group, an alkyl sulfonyl amino group, an aryl sulfonyl amino group, an alkoxy group, an aryloxy group, an aralkyl group, and an acyl group.

When the hydrophobic group of R in the formula (I) is an alkyl group, the alkyl group preferably has 3 to 70 carbon atoms, more preferably 4 to 50, still more preferably 8 to 24, and most preferably, 12.

When R in the formula (I) is a hydrophobic polymer, examples of the hydrophobic polymer include vinyl polymers or vinyl copolymers which are water-insoluble, such as polystyrene and its derivatives, polymethacrylate (e.g., polymethyl methacrylate) and its derivatives, polyacrylate and its derivatives, polybutene polyvinyl acetate, polyvinyl versatate or the like, polyoxyalkylenes which are water-insoluble such as polyoxypropylene or polyoxytetramethylene, and water-insoluble polymers such as polyamide, and polyester and the like. Polystyrene and its derivatives, polymethacrylate and its derivatives, polyacrylate and its derivatives and polyvinylchloride are used particularly preferably. The polymerization degree of the hydrophobic polymer ranges from 2 to 500, preferably from 2 to 200, and more preferably from 2 to 100.

When R in the formula (I) is a hydrophobic group, specific examples which may be used in the present invention include, but are not limited to, the following compounds.

(S-1)

$n\text{-}C_{12}H_{25}$—

(S-2)

$C_{16}H_{33}$—

(S-3)

$C_{12}H_{25}NHCOCH_2$—

(S-4)

$C_{12}H_{25}OCH_2CH_2$—

(S-5)

$(C_{18}H_{37})_2NCH_2CH_2CH_2$—

(S-6)

$C_2H_5SO_2CH_2CH_2$—

(S-7)

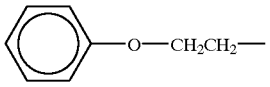

(S-8)

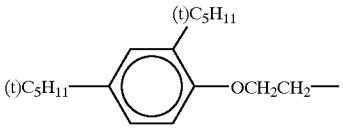

(S-9)

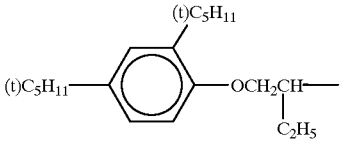

-continued (S-10)

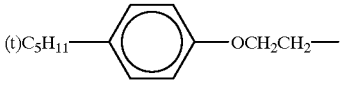

(S-11)

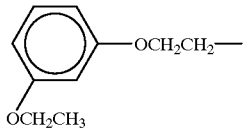

(S-12)

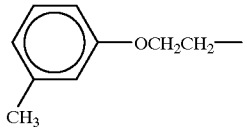

(S-13)

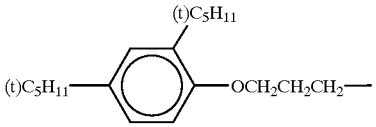

(S-14)

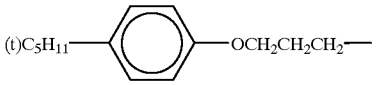

(S-15)

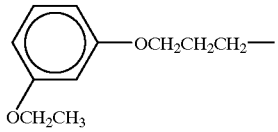

(S-16)

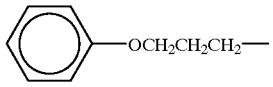

(S-17)

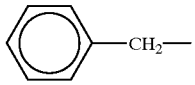

(S-18)

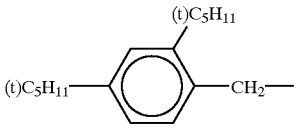

(S-19)

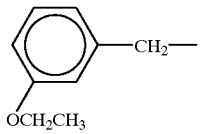

(S-20)

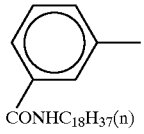

-continued
(S-21)
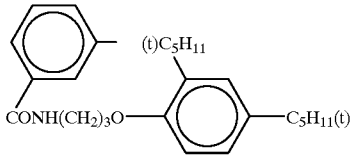
(S-22)
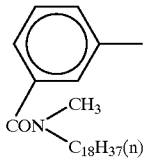
(S-23)
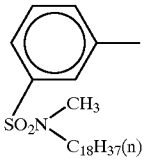
(S-24)
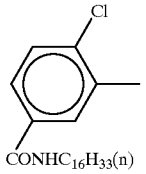
(S-25)
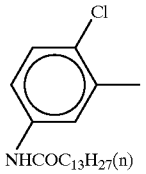
(S-26)
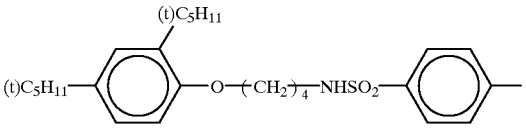
(S-27)
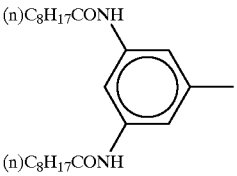
(S-28)
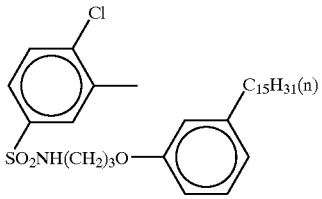
-continued
(S-29)
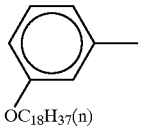
(S-30)
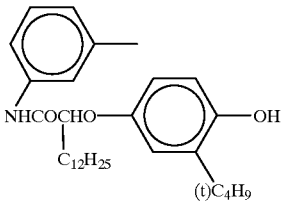
(S-31)
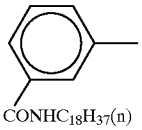
(S-32)
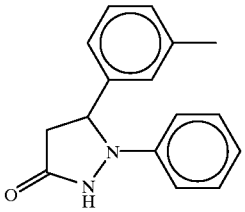
(S-33)
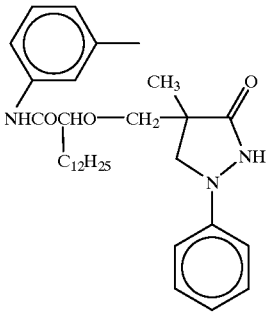
(S-34)
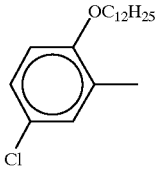
(S-35)
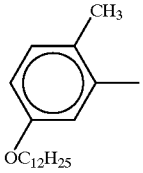

-continued (S-36)

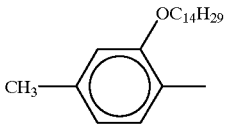

(S-37)

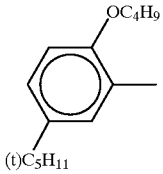

(S-38)

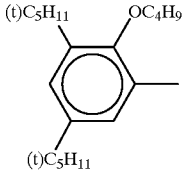

(S-39)

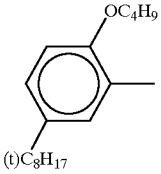

(S-40)

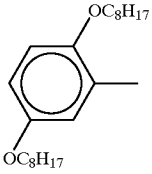

(S-41)

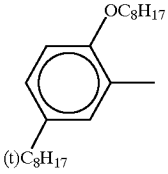

(S-42)

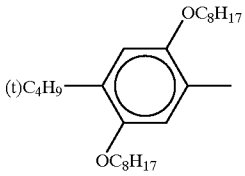

(S-43)

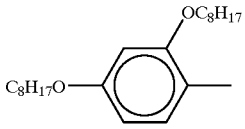

(S-44)

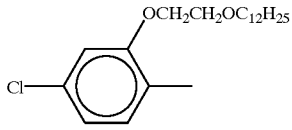

-continued (S-45)

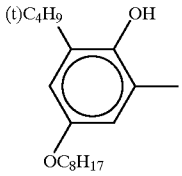

(S-46)

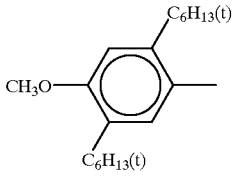

(S-47)

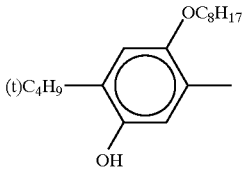

(S-48)

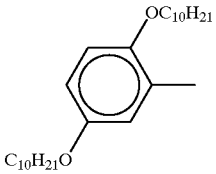

(S-49)

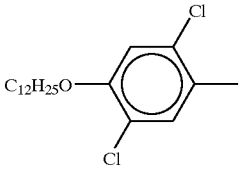

(S-50)

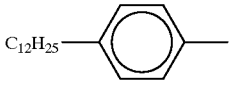

(S-51)

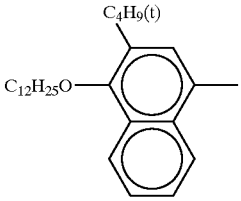

With respect to the compounds represented by the formula (I) in the present invention, a polymer P is a polymer which includes one of the above-described structural units A, B, and C.

Specific examples of the structural unit A for forming polymer P include vinyl alcohol, α-methylvinylalcohol, and α-propylvinylalcohol.

Examples of the structural unit B for forming polymer P include vinyl acetate, vinyl formate, vinyl propionate, and α-substitution products of these compounds.

Further, examples of the structural unit C for forming polymer P include acrylic acid, methacrylic acid, or crotonic acid (each of these includes ammonium salt, or metallic salt such as Na salt, K salt or the like), maleic acid or itaconic acid (each of these includes monoalkylester, ammonium salt, or metallic salt such as Na salt or K salt), vinylphosphonic acid, vinyl sulfuric acid, acrylic sulfonic acid, methacrylic sulfonic acid, 2-acrylamide-3-methylpropanesulfonic acid or 2-methacrylamide-3-methylpropanesulfonic acid (each of these includes ammonium salt, or metallic acid such as Na salt or K salt), and a monomeric unit which ion-dissociates in water, such as acrylamidepropyltrimethylammoniumchloride or methacrylamidepropyltrimethylammoniumchloride.

Among these, a vinyl alcoholic unit is more preferable as the structural unit A, a vinyl acetate unit is more preferable as the structural unit B, and a vinyl monomer unit which contains carboxylic acid (containing ammonium salt or metallic salt such as Na salt or K salt) or sulfonic acid (containing, ammonium salt or metallic salt such as Na salt or K salt) is more preferable as the structural unit C.

The contents of the above-described structural units A, B, and C for forming the polymer P are not particularly limited. However, when the content of the structural unit C is less than or equal to 1 mol %, in order to make the polymer represented by the formula (P) water-soluble or water-dispersible, the content of the structural unit A is preferably between 50 mol % and 100 mol %.

The compounds represented by the formula (I) in the present invention include those within a wide range of compounds from water-soluble to water-dispersible. Provided the compounds represented by the formula (I) are water-soluble or water-dispersible, then even when the polymer P includes a structural unit other than the above-described structural units A, B, and C, there is no problem. Examples of these structural units include an ethylene unit, a propylene unit, an isobutene unit, an acrylonitril unit, an acrylamide unit, a methacrylamide unit, an N-vinylpyrolidone unit, a vinyl chloride unit, or a vinyl fluoride unit.

The polymerization degree of the polymer P ranges from 10 to 3500, preferably from 10 to 2000, more preferably from 10 to 1000, and particularly preferably from 10 to 500.

An example of a lower alkyl group of $R^2$ in the structural units A and B of the polymer P includes an alkyl group having 1 to 10 carbon atoms and particularly preferably, includes a methyl group. Further, the alkyl group can be substituted by a hydroxyl group, an amide group, a carboxyl group, a sulfonic acid group, a sulfinic acid group, or a sulfonamide group.

In the heat-sensitive recording material, gelatin is generally used for its production suitability and its physical properties. When the proportion of the compound of the formula (I) with respect to the gelatin is 1% by weight or more, it is preferable to use a compound having a composition which is compatible with gelatin. In such a compound, the structural unit B is less than or equal to 50 mol %. The structural unit C includes a carboxyl group, and when the structural unit C contains one carboxyl group per unit, the content is greater than or equal to 5 mol %, preferably, greater than or equal to 10 mol %, and particularly preferably, greater than or equal to 15 mol %. When the structural unit C includes n carboxyl groups per unit, the content is preferably 1/n of the aforementioned content. From the viewpoint of compatibility with gelatin, a particularly preferable compound represented by the formula (I) of the present invention is a polymer in which a polymer A is vinylalcohol and has a content of 50 mol % or more, a polymer B is vinyl acetate and has a content of 40 mol % or less, and a polymer C is itaconic acid or maleic acid (which contains ammonium salt, or metallic salt such as Na salt, K salt or the like) and has a content of 2 mol % or more.

The heat-sensitive recording material of the present invention is usually formed by a multilayer structure hydrophilic binders. However, depending upon the layer structure, the compound represented by the formula (I) of the present invention can be used singly as a binder of a certain layer. In such a case, a compound which is not sufficiently compatible with gelatin may be used.

In the compound represented by the formula (I) of the present invention, optimal chemical compositions, molecular weights or the like of P and R which form the compound are different in accordance with the object of the present invention. However, whatever the object of the present invention, a compound in which the weight ratio of P to R is a composition of $0.001 \leqq R:P \leqq 2$, and more preferably, $0.01 \leqq R:P \leqq 1$ has particularly excellent effects.

Specific examples of compounds represented by the formula (I) of the present invention are shown as P-1 to P-37 in Tables 1 to 4 by indicating the polymerization degrees of R, P (which contain structural units A, B, and C) and n and P in the formula (I). However, the present invention is not limited to the same. Moreover, R, P, A, B, C and n in Tables 1 to 4 have already been explained in the formula (I).

TABLE 1

| | | | P | | | | |
|---|---|---|---|---|---|---|---|
| COMPOUND No. | R | POLYMERIZATION DEGREE | CONTENT A (mol %) | CONTENT B (mol %) | CONTENT C (mol %) | POLYMERIZATION DEGREE | n |
| P-1 | (S-1) | — | 98 | 2 | — | 300 | 1 |
| P-2 | (S-1) | — | 88 | 12 | — | 300 | 1 |
| P-3 | (S-1) | — | 98 | 2 | — | 200 | 1 |
| P-4 | $nC_4H_9$ | — | 90 | 10 | — | 78 | 1 |
| P-5 | $tC_8H_{17}$ | — | 88 | 12 | — | 88 | 1 |
| P-6 | $nC_{30}H_{61}$ | — | 88 | 12 | — | 750 | 1 |
| P-7 | $nC_{18}H_{37}$ | — | 98 | 2 | — | 260 | 1 |
| P-8 | $C_{12}H_{25}$(BRANCH) | — | 98 | 2 | — | 300 | 1 |

TABLE 1-continued

| COMPOUND No. | R | POLYMERIZATION DEGREE | P CONTENT A (mol %) | P CONTENT B (mol %) | P CONTENT C (mol %) | | P POLYMERIZATION DEGREE | n |
|---|---|---|---|---|---|---|---|---|
| P-9 | POLYMETHYL METHACRYLATE | 22 | 94.5 | 2.5 | 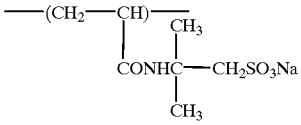 | 3.0 | 110 | 1 |
| P-10 | POLYSTYRENE | 20 | 93.6 | 1.4 | 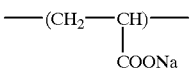 | 5.0 | 150 | 1 |
| P-11 | POLYOXYPROPYLENE | 55 | 79.1 | 15.9 | 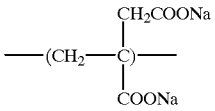 | 5.0 | 440 | 1 |
| P-12 | POLYSTYRENE | 10 | 89.7 | 0.3 | SAME AS ABOVE | 10.0 | 45 | |

TABLE 2

| Compound No. | R | POLYMERIZATION DEGREE | P CONTENT A (mol %) | P CONTENT B (mol %) | P CONTENT C (mol %) | | P POLYMERIZATION DEGREE | n |
|---|---|---|---|---|---|---|---|---|
| P-13 | POLYSTYRENE | 10 | 0 | 70.0 | 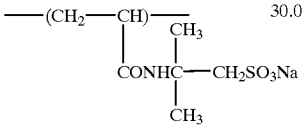 | 30.0 | 105 | |
| P-14 | POLYOXYPROPYLENE | 50 | 95.6 | 2.4 | 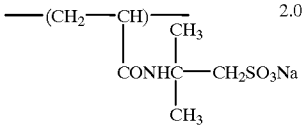 | 2.0 | 110 | 2 |
| P-15 | POLYSTYRENE | 20 | 95.4 | 1.6 | 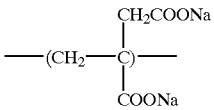 | 3.0 | 85 | 2 |
| P-16 | POLYSTYRENE | 20 | 88 | 2 | SAME AS ABOVE | 5.0 | 300 | 1 |
| P-17 | POLYMETHYL METHACRYLATE | 30 | 88 | 2 | SAME AS ABOVE | 7.5 | 300 | 1 |
| P-18 | POLY N-BUTYL ACRYLATE | 30 | 88 | 2 | SAME AS ABOVE | 10.0 | 300 | 1 |

TABLE 3

| Compound No. | R | POLYMERIZATION DEGREE | P CONTENT A (mol %) | P CONTENT B (mol %) | P CONTENT C (mol %) | | P POLYMERIZATION DEGREE | n |
|---|---|---|---|---|---|---|---|---|
| P-20 | (S-1) | — | 88 | 2 | SAME AS ABOVE | 10.0 | 400 | 1 |
| P-21 | (S-1) | — | 88 | 2 | SAME AS ABOVE | 7.5 | 300 | 1 |
| P-22 | (S-1) | — | 88 | 2 | SAME AS ABOVE | 5.0 | 300 | 1 |
| P-23 | POLY n-BUTYL METHACRYLATE | 10 | 98 | 2 | — | | 300 | 1 |

TABLE 3-continued

| Compound No. | R | POLYMERIZATION DEGREE | P CONTENT A (mol %) | CONTENT B (mol %) | CONTENT C (mol %) | POLYMERIZATION DEGREE | n |
|---|---|---|---|---|---|---|---|
| P-24 | POLYSTYRENE | 20 | 98 | 2 | — | 300 | 1 |
| P-25 | (S-7) | — | 98 | 2 | — | 180 | 1 |
| P-26 | (S-8) | — | 98 | 2 | — | 110 | 1 |
| P-27 | (S-10) | — | 98 | 2 | — | 190 | 1 |
| P-28 | (S-18) | — | 98 | 2 | — | 88 | 1 |
| P-29 | (S-27) | — | 98 | 2 | — | 200 | 1 |
| P-30 | (S-50) | — | 98 | 2 | — | 200 | 1 |
| P-31 | (S-39) | — | 93 | 2 | $-(CH_2-C(CH_2COONa)(COOH))-$ 5.0 | 400 | 1 |
| P-32 | (S-50) | — | 93 | 2 | SAME AS ABOVE | 400 | 1 |

TABLE 4

| Compound No. | R | POLYMERIZATION DEGREE | P CONTENT A (mol %) | CONTENT B (mol %) | CONTENT C (mol %) | POLYMERIZATION DEGREE | n |
|---|---|---|---|---|---|---|---|
| P-33 | (S-1) | — | 93 | 2 | $-(CH(COONa)-CH(COONa))-$ 5.0 | 300 | 1 |
| P-34 | (S-39) | — | 93 | 2 | SAME AS ABOVE | 300 | 1 |
| P-35 | (S-50) | — | 93 | 2 | SAME AS ABOVE | 300 | 1 |
| P-36 | POLYSTRYENE | 20 | 93 | 2 | SAME AS ABOVE | | 1 |
| P-37 | (S-1) | — | 88 | 2 | $-(CH_2-C(CH_2COONa)(COONa))-$ 5.0 | 200 | 1 |

The compound represented by the formula (I) can be formed by methods which are described in Japanese Patent Application Laid Open (JP-A) Nos. 62-288643, 61-254237, 61-254238, 61-254239, and 61-254240. Further, when the polymer R in polymers of the formula (I) is an alkyl group, it is available as a commercial product (e.g., MP-103, MP-203, and MP-102 manufactured by Kuraray Co., Ltd.).

The action which prevents the microcapsules or latexes from becoming aggregated is not clear, but the compound has a hydrophobic property in the molecules thereof and also has a polymer unit. For this reason, due to the affinity of the microcapsule shells or the surfaces of the dispersed latex particles with this hydrophobic group, the compound is absorbed by the particle surface, while polymerization units exist at the dispersing medium. As a result, this property contributes to the dispersion stability.

In the present invention, on the assumption that a color-developing compound of the heated portion of the heat-sensitive recording material is reacted by heating imagewise so as to develop color, either of a full color heat-sensitive recording layer or a monocolor heat-sensitive recording layer can be used as a heat-sensitive recording layer.

When the heat-sensitive recording layer of the present invention uses a monocolor heat-sensitive recording layer, the layer includes a substantially colorless color-developing compound A and a substantially colorless color-developing compound B which reacts with the color-developing compound A so as to develop color. The color-developing compound A and the color-developing compound B which are used in the present invention are compounds which mutually generate color-developing reaction by heating. Examples 1) to 13) of combinations of such compounds are described below:

1) a combination of photodecompositive diazo compounds and couplers;
2) a combination of electron donative dye precursors and electron acceptive compounds;
3) a combination of organometallic salts such as silver behenate and silver stearate, and reductants such as protocatechuic acid, spiroindan, and hydroquinone;
4) a combination of long-chain fatty acid salts such as ferric stearate and ferric myristylate and phenols such as tannin acid, gallic acid and ammonium salycylate;
5) a combination of organic acid heavy metal salts such as nickel, cobalt, zinc, copper, iron, mercury, and silver salts of acetic acid, stearic acid, and palmitic acid either with alkaline earth metal sulfides such as calcium sulfide, strontium sulfide, and potassium sulfide, or with organic chelates such as s-diphenylcarbazide and diphenylcarbazone;
6) a combination of heavy metal sulfates such as sulfates of silver, zinc, mercury, and sodium, and sulfur compounds such as Na-tetrathionate, sodium thiosulfate and thiourea;

7) a combination of fatty acid ferric salts such as ferric stearate, and aromatic polyhydroxy compounds such as 3,4-hydroxytetraphenylmethane;
8) a combination of organic acid metallic salts such as oxalate and mercury oxalate, and organic polyhydroxy compounds such as polyhydroxyalcohol, glycerin, and glycol;
9) a combination of fatty acid ferric salts such as ferric pelargonate and ferric laurate, and thiocetylcarbamide or isothiocetylcarbamide derivatives;
10) a combination of organic acid lead salts such as lead caprate, lead pelargonate, and lead behenate, and thiourea derivatives such as ethylenethiourea, and N-dodecylthiourea;
11) a combination of higher fatty acid heavy metal salts such as ferric stearate and cupric stearate and zinc dialkylditiocarbamate.
12) a combination of resorcine and nitoroso compounds for forming oxazine dye; and
13) a combination of formazan compounds and reductants and/or metallic salts.

Among these combinations, in the present invention, 1) the combination of photodecompositive diazo compounds and couplers, 2) the combination of electron donative dye precursors and electron acceptive compounds, and 3) the combination of organometallic salts and reductants are preferable, the combinations 1) and 2) are more preferable, and the combination 1) is particularly preferable.

When a combination is applied to a full-color heat-sensitive recording material, a combination in which the reaction of diazonium salt compounds and couplers is used so as to develop color, or a combination in which the reaction of electron donative colorless dyes and electron acceptive compounds is used so as to develop color is particularly preferable.

In the present invention, the method of using the above-described diazonium salt compounds, couplers which react with the diazonium salt compounds so as to develop color, basic substances, electron donative colorless dyes, electron acceptive compounds, and sensitizers is not particularly limited. Namely, there are employed methods in which these substances are (1) solidly dispersed, (2) emulsified and dispersed, (3) polymer dispersed, (4) latex dispersed, (5) encapsulated in a microcapsule, or the like. However, among these methods, from a storage point of view, a method in which the substances are encapsulated in microcapsules is preferable. In the color-developing system using the reaction of diazonium compounds and couplers, diazonium salt compounds are encapsulated in microcapsules are preferable. In the color-developing system using the reaction of electron donative colorless dyes and electron acceptive compounds, electron donative colorless dyes encapsulated in microcapsules are preferable.

The present invention uses compounds which can prevent aggregation or unification of microcapsules, emulsion, and latex and promote dispersion stability of the solid dispersions. Accordingly, the present invention can provide excellent images having excellent glossiness and uniform graininess. However, the gram diameters of microcapsules range from 0.1 Ξm to 1.0 $\mu$m, which magnitude cannot be negligible as compared to a latex grain diameter which is usually less than or equal to 0.2 $\mu$m. In spite of this, even when these microcapsules are used, high quality and high glossiness images can be obtained due to the excellent dispersion stability and homogeneous graininess of the compounds according to the present invention As a result, the most noticeable effect of the present invention can be obtained when microcapsules are used.

At this time, the compound represented by the formula (I) is added to the heat-sensitive recording material during the emulsification dispersion of the compounds or during the adjustment of a coating solution for a layer which contains the aforementioned microcapsule or latex dispersed matter. As a result, an excellent effect of the present invention can be obtained.

When the additive is a microcapsule dispersion solution or an emulsion, it is preferably added in an amount of about 0.5 to 15 wt. % of the capsule solid matter or oil droplet. When the additive is a latex dispersion solution, it is preferably added in an amount of about 1 to 20 wt. % of the latex.

A more detailed description of the respective color-developing compounds will be given hereinafter.

Compounds used for a heat-sensitive recording layer which contains diazonium salt compounds and couplers which react with the diazonium salt compounds by heating to develop color include: diazonium salt compounds; couplers which react with the diazonium salt compounds to form dyes, and basic substances which promote the reaction of the diazonium salt compounds and the couplers. The diazonium salt compounds are those described below which are capable of controlling a maximum absorption wavelength due to the positions or types of substituents of the Ar portion.

$$Ar—N_2^+X^-$$

wherein Ar represents an aryl group, and X represents an acid anion.

Specific examples of diazonium salt compounds in the present invention include: acid anion salts such as 4-(N-(2-(2,4-di-tert-amylphenoxy)butyryl)piperazino) benzenediazonium, 4-dioctylaminobenzenediazonium, 4-(N-(2-ethylhexanoyl) piperazino) benzenediazonium, 4-dihexylamino-2 -hexyloxybenzenediazonium, 4-N-ethyl-N-hexadecylamino-2-ethoxybenzodiazonium, 3-chloro-4-dioctylamino-2-octyloxyobenzenediazonium, 2,5-dibutoxy-4-morphorinobenzenediazonium, 2,5-octoxy-4-morphorinobenzenediazonium, 2,5-dibutoxy-4-(N-(2-ethylhexanoyl)piperazino)benzenediazonium, 2,5-diethoxy-4-(N-(2-(2,4-di-tert-aminophenoxy)butyryl)piperazino) benzenediazonium, 2,5-dibuthoxy-4-tolylthiobenzene diazonium, 3-(2-octyloxyethoxy)-4-morphorinobenzenediazonium and the like, and the below listed diazonium salt compounds D-1 to D-5. Hexafluorophosphate salts, tetrafluoroborate salts, and 1,5-naphthalenesulfonate salts are particularly preferable.

D-1

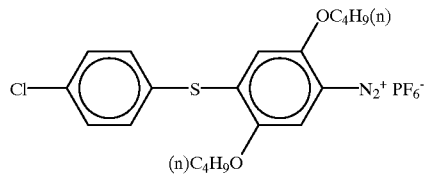

D-2

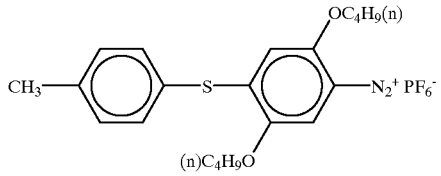

-continued

D-3

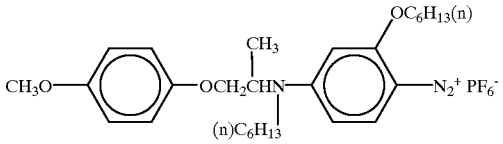

D-4

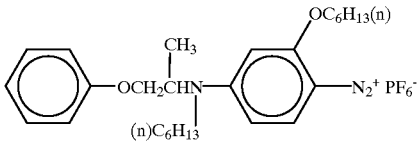

D-5

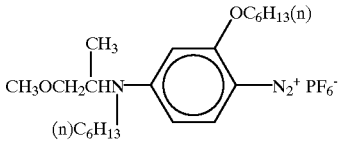

Among these diazonium salt compounds, particularly preferable compounds of the present invention which are photodecomposed by light having a wavelength of 300 to 400 nm include: 4-(N-(2-(2,4-di-tert-amylphenoxy)butyryl) piperazino) benzenediazonium, 4-dioctylaminobenzenediazonium, 4-(N-(2-ethylhexanoyl)piperazino) benzenediazonium, 4-dihexylamino-2-hexyloxybenzenediazonium, 4-N-ethyl-N-hexadecylamino-2-ethoxybenzodiazonium, 2,5-dibutoxy-4-(N-(2-ethylhexanoyl) piperazino)benzenediazonium, 2,5-diethoxy-4-(N-(2-(2,4-di-tert-amylphenoxy)butyryl) piperazino)benzenediazonium or the compounds described in the aforementioned specific Examples D-3 to D-5. The maximum absorption wavelength of these diazonium salt compounds is determined by measuring each of the compounds formed into a coating film having a thickness of 0.1 $g/m^2$ to 1.0 $g/m^2$ by a spectrophotometer (Shimazu MPS-2000).

Couplers, which are used in the present invention and react with the aforementioned diazonium salts by heating so as to develop color, include: resorcin, phloroglucin, sodium 2,3-dihydroxynaphthalene-6-sulfonate, 1-hydroxy-2-naphthoic acid morpholinopropylamide, 1,5-dihydroxynaphthalene, 2,3-dihydroxynaphthalene, 2,3-dihydroxy-6-sulfanyl-naphthalene, 2-hydroxy-3-naphthoic acid anilide, 2-hydroxy-3-naphthoic acid ethanolamide, 2-hydroxy-3-naphthoic acid octylamide, 2-hydroxy-3-naphthoic acid-N-dodecyloxypropylamide, 2-hydroxy-3-naphthoic acid tetradecylamide, acetanilide, acetoacetanilide, benzoylacetanilide, 2-chloro-5-octylacetoacetanilide, 1-phenyl-3-methyl-5-pyrazolone, 1-(2', octylphenyl)-3-methyl-5-pyrazolone, 1-(2',4',6'-trichlorophenyl)-3-benzamide-5-pyrazolone, 1-(2',4',6'-trichlorophenyl)-3-anilino-5-pyralone, 1-phenyl-3-phenylacetamide-5-pyrazolone, and the below-listed compounds C-1 to C-6. Two or more of these couplers can be mixed to obtain the desired color-developing hue.

C-1

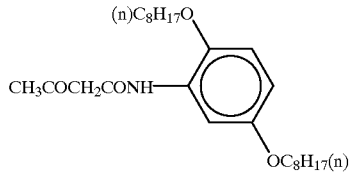

C-2

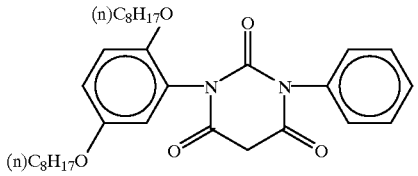

C-3

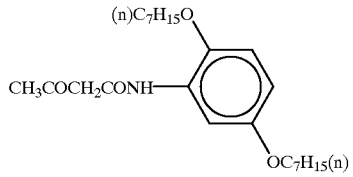

C-4

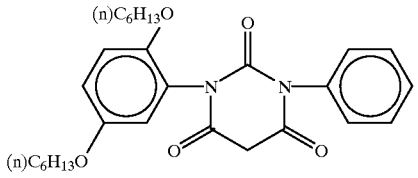

C-5

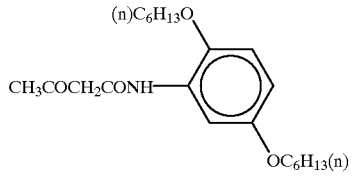

C-6

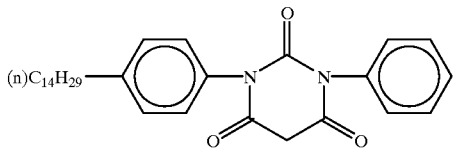

In addition to inorganic or organic basic compounds, basic substances include compounds which decompose or the like and generate alkali substances when heated. Typical examples of these compounds include: nitrogen-containing compounds; such as organic ammonium salts, organic amine, amide, urea and thiourea, and derivatives thereof, and thiazoles, pyrrols, pyrimidines, piperazines, guanizines, indoles, imidazoles, imidazolines, triazoles, morpholines, pyperidines, amidines, formazines, pyridines and the like. Specific examples of these compounds include tricyclohexylamine, tribenzylamine, octadecylbenzylamine, stearylamine, aryl urea, thiourea, methyl thiourea, aryl thiourea, ethylene thiourea, 2-benzylimidazole, 4-phenylimidazole, 2-phenyl-4-methylimidazole, 2-undecylimidazoline, 2,4,5-trifuryl-2-imidazoline, 1,2-diphenyl-4,4-dimethyl-2-imidazoline, 2-phenyl-2-imidazoline, 1,2,3-triphenylguanidine, 1,2-dicyclohexylguanidine, 1,2,3-tricyclohexylguanidine, guanidinetrichloroacetate, N,N'-dibenzylpiperadine, 4,4'-dithiomorpholine, morpholiniumtrichloroacetate, 2-aminobenzothiazole, 2-benzoylhydradinobenzothiazole, and the like. Two or more of these compounds can used in combination.

Microcapsules having wall films formed by polyurethane or polyurea resin are manufactured in the following manner. Polyvalent isocyanate or the like as a precursor for the microcapsule walls is added to the capsule core material. The resultant mixture is emulsified in a water-soluble high polymer solution such as polyvinyl alcohol or the like. The resultant solution is heated so as to perform a high polymer forming reaction at the oil drop interfaces.

In a method of emulsifying color-developing compounds according to the present invention, first, a color-developing compound is dissolved in oil. This oil can be solid, liquid or polymer at normal temperature. Such oils include low boiling point co-solvents such as acetic ester, methylenechloride, and cyclohexanone and/or phosphate ester, phthalate ester, acrylate ester, methacrylate ester, other carboxylilc acid ester, fatty acid amide, alkylated biphenyl, alkylated terphenyl, alkylated naphthalene, diarylethane, chlorinated paraffin, alcohols, phenols, ethers, monolefines, epoxys, and the like. Specific examples of such compounds include high boiling point oils such as tricresyl phosphate, trioctyl phosphate, octyldiphenyl phosphate, tricyclohexyl phosphate, dibutyl phthalate, dioctyl phthalate, dilauryl phthalate, dicyclohexyl phthalate, olefinic acid butyl, diethyleneglycolebenzoate, dioctyl sebacate, dibutyl sebacate, dioctyl adipate, trioctyl trimellitate, acetyltriethyl citrate, octyl maleate, dibutyl maleate, isoamylbiphenyl, chlorinated paraffin, diisopropylnaphthalene, 1,1'-ditolyethane, 2,4-ditertiaryamylphenol, N,N'-dibutyl-2-buthoxy-5 -tertiaryoctylaniline, 2-ethylhexyl hydroxybenzonate, and polyethyleneglycole. However, among these compounds, it is particularly preferable to use alcohols, phosphoric esters, carboxylic acid esters, alkylated biphenyl, alkylated terphenyl, alkylated naphthalene, and diarylethane. Further, carbonization inhibitors such as hindered phenol and hindered amine can be added to the aforementioned high boiling point oils. Moreover, it is particularly preferable to use oils having unsaturated fatty acid such as α-methylstyrenedimer. As the α-methylstyrenedimer, for example, MSD100 (manufactured by Mitsui Toatsu Co., Ltd.) can be used.

An oil solution containing the aforementioned color-developing compound is added to a water-soluble high polymer solution. The resultant mixture is emulsified by a colloid mill, a homogenizer or an ultrasonic wave. In this case, a water-soluble high polymer such as polyvinyl alcohol is used, and an emulsion or latex having a hydrophobic high polymer can be used together with this compound. Examples of such water-soluble high polymers include polyvinyl alcohol, silanol denaturated polyvinyl alcohol, carboxy denaturated polyvinyl alcohol, amino denaturated polyvinyl alcohol, itaconic acid denaturated polyvinyl alcohol, styrene-maleic anhydride copolymer, butadiene-maleic anhydride copolymer, ethylene-maleic anhydride copolymer, isobutylene-maleic anhydride copolymer, polyacrylamide, polystyrenesulfonic acid, polyvinylpyrolidone, ethylene-acrylic acid copolymer, gelatin and their derivatives. Among these, carboxy denaturated polyvinyl alcohol, and acylated gelatin (e.g., gelatin phthalate) are particularly preferable. Examples of hydrophobic high polymer emulsions or latices include styrene-butadiene copolymer, carboxy denaturated styrene-butadiene copolymer, and acrylonitrile-butadiene copolymer. In this case, conventionally known surfactants can be added as needed.

As a method of producing microcapsules, a conventionally known method can be used. Namely, a color-developing compound, preferably, a diazonium compound, and a precursor for a microcapsule wall are dissolved in organic solvent that is difficult, or not soluble in water. The resultant solution is added to a water-soluble high polymer aqueous solution and is emulsified by means of a homogenizer or the like. The high polymer substance for the microcapsule walls can be prepared by forming wall films at the boundary faces of the oil droplets and water under heat. Specific examples of high polymer compounds for forming microcapsule wall films include polyurethane resin, polyurea resin, polyamide resin, polyester resin, polycarbonate resin, aminoaldehyde resin, melamine resin, polystyrene resin, styrene-acrylate copolymer resin, styrene-methacrylate copolymer resin, gelatin, and polyvinyl alcohol. Among these, as a wall agent, particularly preferable is a microcapsule having a wall film which consists of polyurethane polyurea resin.

Specific examples of polyvalent isocyanate compounds are partially described below. For example, diisocyanates such as m-phenylenediisocyanate, p-phenylenediisocyanate, 2,6-trilenediisocyanate, 2,4-trilenediisocyanate, naphthalene-1,4-diisocyanate, diphenylmethane-4,4'-diisocyanate, 3,3'-diphenylmethane-4,4'-diisocyanate, xylene-1,4-diisocyanate, 4,4'-diphenylpropanediisocyanate, trimethylenediisocyanate, hexamethylenediisocyanate, propylene-1,2-diisocyanate, butylene-1,2-diisocyanate, cyclohexylene-1,2-diisocyanate, and cyclohexylene-1,4-diisocyanate; triisocyanates such as 4,4',4"-triphenylmethanetriisocyanate and toluene-2,4,6-triisocyanate; tetraisocyanates such as 4,4'-dimethyldiphenylmethane-2,2' and 5,5'-tetraisocyanate; and isocyanate prepolymers such as an adduct of hexamethylenediisocyanate and trimethylolpropane, an adduct of 2,4-tolylenediisocyanate and trimethylolpropane, an adduct of xylylenediisociatante and trimethylolpropane; and an adduct of tolylenediisocyanate and hexantriol. Two or more of the aforementioned compounds can be mixed as needed. Among these, particularly preferable is a compound having three or more of isocyanate groups in a molecule.

In the method of producing microcapsules, as an organic solvent for dissolving color-developing compounds, the above-listed oils used in the emulsion dispersion can be used. Further, the same applies for the water-soluble high polymers. Preferably, each microcapsule particle has a diameter of 0.1 to 1.0 μm, and more preferably, has a diameter of 0.2 to 0.7 μm.

Other preferable color-developing compounds used in the present invention are electron donative dye precursors. Examples of electron donative precursors include: triallylmethane compounds, diphenylmethane compounds, thiazine compounds, xanthene compounds, and spiropyrane compounds. Specifically, triarylmethane compounds and xanthene compounds are useful because they can produce high color-developing densities. These compounds include 3,3-bis (p-dimethylaminophenyl)-6-dimethylaminophthalide (i.e., crystal violet lactone), 3,3-bis (p-dimethylamino) phthalide, 3-(p-dimethylaminophenyl)-3-(1,3-dimethylindole-3-yl) phthalide, 3-(p-dimethylaminophenyl)-3-(2-methylindole-3-yl) phthalide, 3-(o-methyl-p-diethylaminophenyl)-3-(2-methylindole-3-yl) phthalide, 4,4'-bis (dimethylamino) benzhydrinebenzyl ether, N-halophenylleukoauramine, N-2,4,5-trichlorophenylleukoauramine, rhodamine-B-anilinolactam, rhodamine (p-nitroanilino) lactam, rhodamine-B-(p-chloroanilino) lactam, 2-benzilamino-6-diethylaminofluoran, 2-anilino-6-diethylaminofluoran, 2-anilino-3-methyl-6-diethylaminofluoran, 2-anilino-3-methyl-6-cyclohexylmethylaminofluoran, 2-anilino-3-methyl-6-isoamylethylaminofluoran, 2-(o-chloroanilino)-6-diethylaminofluoran, 2-octylamino-6-diethylaminofluoran, 2 -ethoxyethylamino-3-chloro-2-diethylaminofluoran, 2-anilino-3-chloro-6-diethylaminofluoran, benzoilleukomethylene blue, p-nitrobenzilleukomethylene blue, 3-methyl-spiro-dinaphtopyran, 3-ethyl-spiro-dinaphtopyran, 3,3'-dichloro-spiro-dinaphtopyran, 3-benzilspirodinaphtopyran, and 3-propyl-spiro-dibenzopyran.

Examples of electron acceptive compounds include phenol derivatives, salicylic acid derivatives, and hydroxy benzoic ester. Bisphenols and hydroxy benzoic esters are particularly preferable. Examples of these compounds include 2,2-bis (p-hydroxyphenyl) propane (i.e., bisphenol A), 4,4'-(p-phenylenediisopropylidene) diphenol (i.e., bisphenol P), 2,2-bis (p-hydroxyphenyl) pentane, 2,2-bis (p-hydroxyphenyl) ethane, 2,2-bis (p-hydroxyphenyl) butane, 2,2-bis (4'-hydroxy-3',5'-dichlorophenyl) propane, 1,1-(p-hydroxyphenyl)cyclohexane, 1,1-(p-hydroxyphenyl) propane, 1,1-(p-hydroxyphenyl) pentane, 1,1-(p-hydroxyphenyl)-2-ethylhexane, 3,5-di (π-methylbenzil) salicylic acid and its polyvalent metallic salts, 3,5-di (tert-butyl) -salicylic acid and its polyvalent metallic salts, 3-α, α-dimethylbenzilsalicylic acid and its polyvalent metallic salts, butyl p-hydroxybenzoate, benzil p-hydroxybenzoate, 2-ethylhexyl p-hydroxybenzoate, and p-phenylphenol, p-cumylphenol.

As intensifiers, low melting point organic compounds which appropriately include aromatic groups and polar groups in a molecule are preferable. Examples of such intensifiers include benzil p-benziloxybenzoate, α-naphthylbenzil ether, β-naphthylbenzil ether, phenyl β-naphthoate, phenyl α-hydroxy-p-naphthoate, β-naphthol-(p-chlorobenzil) ether, 1,4-butanediolphenyl ether, 1,4-butanediol-p-methylphenyl ether, 1,4-butanediol-p-ethylphenylether, 1,4-butanediol-m-methylphenylether, 1-phenoxy-2-(p-tolyloxy) ethane, 1-phenoxy-2-(p-ethylphenoxy) ethane, 1-phenoxy-2-(p-chlorophenoxy) ethane, and p-benzilbiphenyl.

In the present invention, a multicolor heat-sensitive recording material may be obtained by superposing the above-described heat-sensitive recording layers and changing the hue of each heat-sensitive recording layer. The layer structure is not particularly limited. However, a multicolor heat-sensitive recording material preferably comprises two heat-sensitive recording layers which respectively contain different diazonium salt compounds having different absorption wavelengths and corresponding couplers which react with the diazonium salt compounds through the application of heat to thereby develop different hues and a heat-sensitive recording layer which contains an electron donative colorless dye and an electron acceptive compound. Further, a multicolor heat-sensitive recording material preferably comprises three heat-sensitive recording layers which respectively contain different diazonium salt compounds having different absorption wavelengths and corresponding couplers which react with the diazonium salt compounds through application of heat to thereby develop different hues. The latter is particularly preferable.

A heat-sensitive recording material preferably comprises a heat-sensitive recording layer which is provided on a support and contains an electron donative dye and an electron acceptive compound, a light-fixation type heat-sensitive recording layer which contains a diazonium salt compound having a maximum absorption wavelength of 400±20 nm and a coupler which reacts with the diazonium salt compound so as to thereby develop color, a light-fixation type heat-sensitive recording layer which contains a diazonium salt compound having a maximum absorption wavelength of 360±20 nm and a coupler which reacts with the diazonium salt compound to thereby develop color, in this order, and a light transmittance adjusting layer and a protective layer which are provided on these layers.

Further, a heat-sensitive recording material preferably comprises a light-fixation heat-sensitive recording layer which is provided on a support and contains a diazonium salt compound having a maximum absorption wavelength of 340±20 nm or less and a coupler which reacts with the diazonium salt compound to thereby develop color, a light-fixation heat-sensitive recording layer which contains a diazonium salt compound having a maximum absorption wavelength of 360±20 nm and a coupler which reacts with the diazonium salt compound to thereby develop color, and a light-fixation type heat-sensitive recording layer which contains a diazonium salt compound having a maximum absorption wavelength of 400±20 nm and a coupler which reacts with the diazonium salt compound to thereby develop color, in this order, and a light transmittance adjusting layer and a protective layer which are provided on these layers.

Namely, a multicolor heat-sensitive recording layer preferably comprises a first heat-sensitive recording layer which is provided on a support and contains an electron donative colorless dye and an electron acceptive compound or a diazonium salt compound having a maximum absorption wavelength of 340 nm or less and a coupler which reacts with the diazonium salt compound through the application of heat to thereby develop color, a second heat-sensitive recording layer which contains a diazonium salt compound having a maximum absorption wavelength of 360±20 nm and a coupler which reacts with the diazonium salt compound through the application of heat to thereby develop color, and a third heat-sensitive recording layer which contains a diazonium salt compound having a maximum absorption wavelengh of 400±20 nm and a coupler which reacts with the diazonium salt compound through the application of heat to thereby develop color. In this example, the hue to be developed in each heat-sensitive recording layer may be selected so as to be one of the three primary colors in a subtractive color process, i.e., yellow, magenta, cyan, thereby allowing a full-color image to be recorded.

An image is recorded on this multicolor heat-sensitive recording material in the following manner. First, the third heat-sensitive recording layer is heated so that the diazonium salt compound and the coupler contained therein develop color. Next, the unreacted diazonium salt compound contained in the third heat-sensitive recording layer is decomposed by irradiation with light having a wavelength of 400±20 nm. Subsequently, the second heat-sensitive recording layer is sufficiently heated so that the diazonium salt compound and the coupler contained therein develop color. At this time, the third heat-sensitive recording layer is also intensely heated but does not develop color any more since the diazonium salt compound contained in the third heat-sensitive recording layer has already decomposed and thus has lost its color-developing capability. Further, the multicolor heat-sensitive recording layer is irradiated with light having a wavelength of 360±20 nm so as to decompose the diazonium salt compound contained in the second heat-sensitive recording layer. Lastly, the first heat-sensitive recording layer is sufficiently heated, thereby causing the first heat-sensitive recording layer to develop color. At this time, the third and second heat-sensitive recording layers are also intensively heated but do not develop color any more since the diazonium salt compounds contained in the third and second heat-sensitive recording layers are already decomposed and thus have lost their color-developing capability.

In order to improve light-fastness of the heat-sensitive recording material of the present invention, the below-described known antioxidants can be used. Such antioxidants are disclosed, for example, in European Patent Nos. 310551, 310552, 459416, 223739, 309402, and 309401, German Patent No. 3435443, U.S. Pat. Nos. 4814262 and 4980275, Japanese Patent Application Laid-Open (JP-A) Nos. 3-121449, 2-262654, 2-71262, 63-163351, 54-48535, 5-61166, 5-119449, 63-113536, and 62-262047.

Specific examples of such antioxidants include:

Q-1

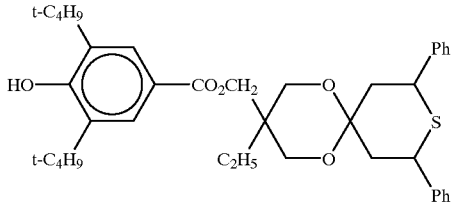

Q-2

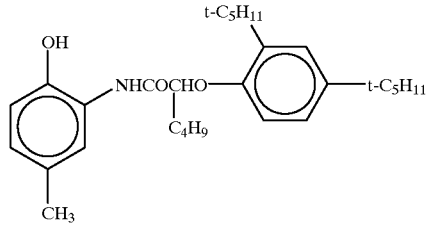

Q-3

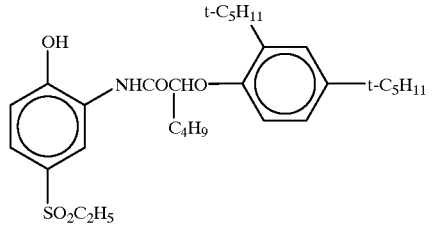

Q-4

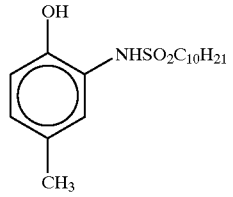

Q-5

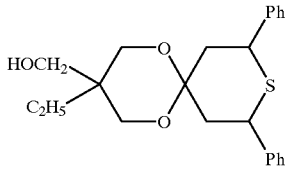

Q-6

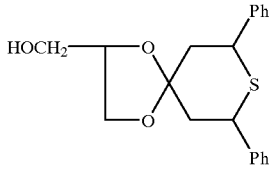

-continued
Q-7
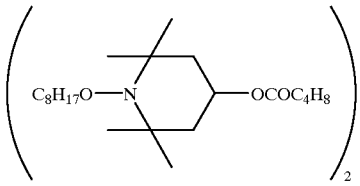
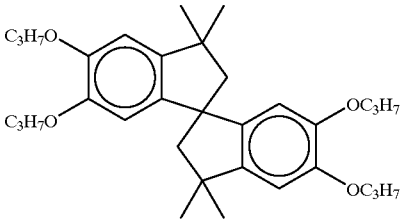
Q-8
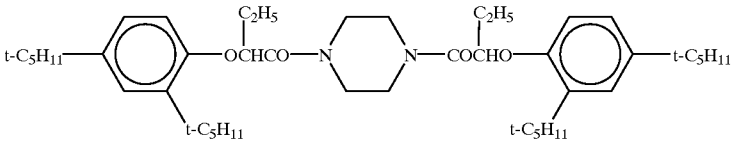
Q-9
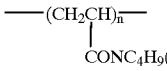
Q-10
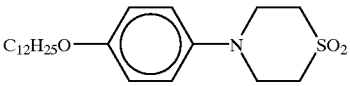
Q-11
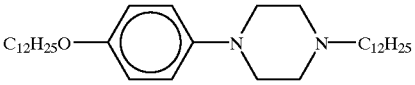
Q-12
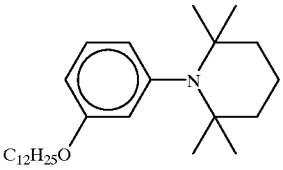
Q-13
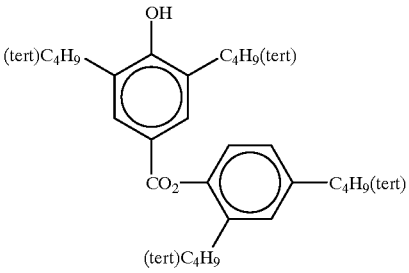

-continued
Q-14
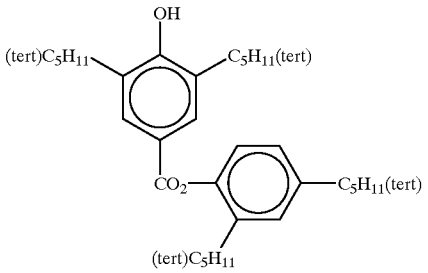
Q-15
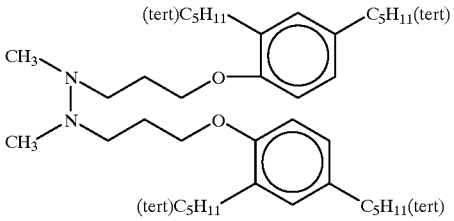
Q-16
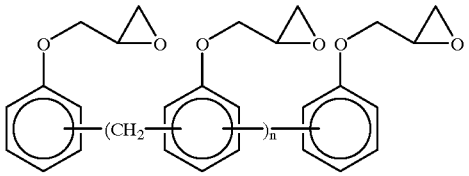
Q-17
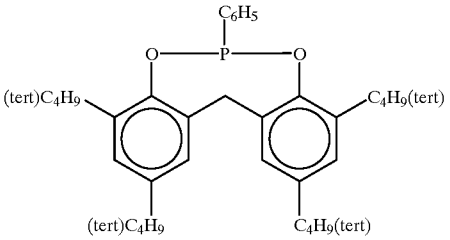
Q-18
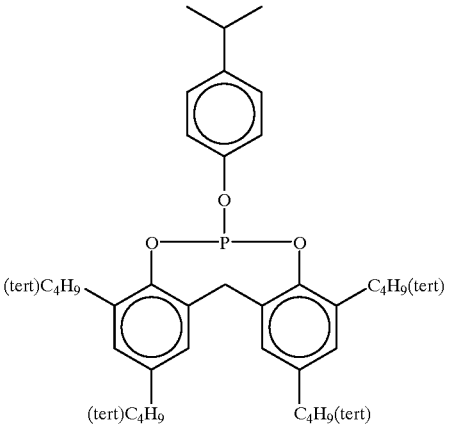

-continued
Q-19
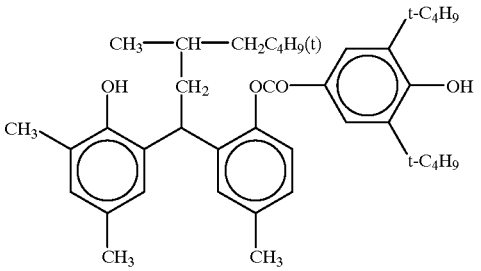
Q-20
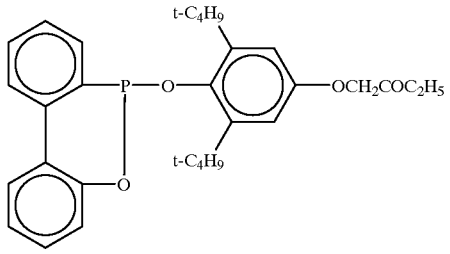
Q-21
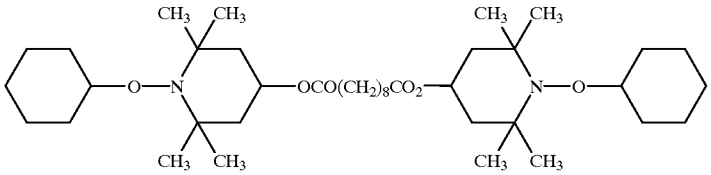
Q-22
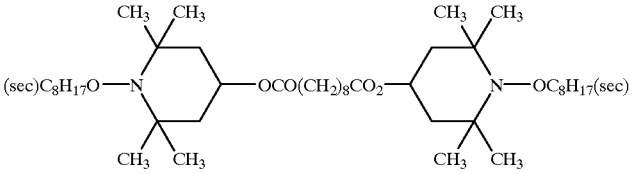
Q-23
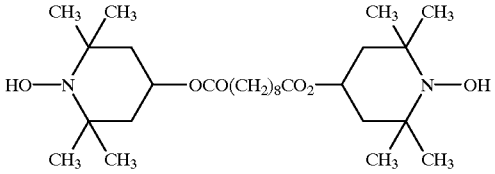
Q-24
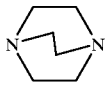
Q-25
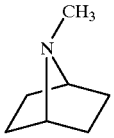
Q-26
$(C_{14}H_{27}OCOCH_2CH_2)_2S$
Q-27
$(C_{18}H_{37}OCOCH_2CH_2)_2S$
Q-28
$C_{12}H_{25}SCH_2CH_2CO_2CH_2)_4C$ In the present invention, the light transmittance adjusting layer contains therein a compound which acts as a precursor of a UV absorbent. Since the precursor does not act as a UV absorbent before the light transmittance adjusting layer is irradiated with light having the necessary range of wavelength to fix an image thereto, light transmittance through the layer is high. When images are fixed to the light-fixation type heat-sensitive recording layer, light having the necessary range of wavelength to fix images thereto sufficiently transmits through the layer. The transmittance of visible light through this layer is so high that images can be successfully fixed to the heat-sensitive recording layer.

After the light-fixation type heat-sensitive recording layer has been irradiated with light having the necessary range of wavelength to fix images thereto, the precursor of a UV absorbent acts as a UV absorbent through reaction of light or heat. Most of the light having the necessary range of wavelength to fix images to a UV area is absorbed by the UV absorbent. Accordingly, the transmittance through the UV area decreases, while the light-fastness of the heat-sensitive recording material increases. However, since the precursor of a UV absorbent cannot absorb visible light, the transmittance of visible light remains as it is.

At least one light transmittance adjusting layer can be provided in a light-fixation type heat-sensitive recording material. It is most preferable to form the light transmittance adjusting layer between the light-fixation heat-sensitive recording layer and the outermost protective layer. However, the light transmittance adjusting layer can be used as a protective layer. Any properties of the light transmittance adjusting layer can be selected in accordance with the properties of the light-fixation type heat-sensitive recording layer.

Specially, the present invention is effectively applicable to a heat-sensitive recording material that preferably comprises: a light-fixation type heat-sensitive recording layer which is provided on a support and contains a diazonium salt compound having a maximum absorption wavelength of 360±20 =n and a coupler which reacts with the diazonium salt compound to thereby develop color, a light-fixation heat-sensitive recording layer which contains a diazonium salt compound having a maximum absorption wavelength of 400±20 nm and a coupler which reacts with the diazonium salt compound so as to develop color, and a light transmittance adjusting layer which is provided on these layers. In the case of the above-described heat-sensitive recording material, the transmittance of light to the light transmittance adjusting layer in a range of wavelength to fix images is preferably greater than or equal to 65% at 360 nm. After images have been fixed, the transmittance of light to the light transmittance adjusting layer is preferably less than or equal to 20% at 360 nm. In this case, "light irradiation" means that light having a wavelength of 420 nm is irradiated using a xenon lamp apparatus in an amount of 13 $kJ/m^2$. Specifically, light is irradiated by a Weather Ometer Ci65 (manufactured by Atlas Electric Co., Ltd.) in an amount of 0.9 $W/m^2$ for 4.0 hours.

The present invention is applied to a case in which a heat-sensitive recording material comprises a light-fixation type heat-sensitive recording layer which contains a diazonium salt compound having a maximum absorption wavelength which is less than 340 nm and a coupler which reacts with the diazonium salt compound to thereby develop color, and a light-fixation type heat-sensitive recording layer which contains a diazonium salt compound having a maximum absorption wavelength which exceeds 420 nm and a coupler which reacts with the diazonium salt compound to thereby develop color.

In a heat-sensitive recording layer, a multicolor heat-sensitive recording material is obtained by changing the hue of each of the heat-sensitive recording layers. Namely, the hue to be developed in each multicolor heat-sensitive recording layer may be selected so as to be one of three primary colors in a subtractive color process, i.e., yellow, magenta, cyan, thereby enabling an image to be recorded in full color. In this case, the color-developing mechanism of the heat-sensitive recording layer which is provided directly on a support (the lowest layer of the heat-sensitive recording layer) can use any of a color developing type which comprises an electron donative dye and an electron acceptive dye, a diazo color-developing type which contains a diazonium salt and a coupler which reacts with the diazonium salt to thereby develop color, a base color developing type which develops color by contacting a basic compound, a chelate color developing type, and a color developing type which reacts with nucleophile, causing elimination reaction to thereby develop color. However, a diazo color developing type is preferable. This heat-sensitive recording layer preferably comprises thereon two light-fixation type heat-sensitive recording layers which respectively contain different diazonium salt compounds having different maximum absorption wavelengths and corresponding couplers which react with the diazonium salt compounds to thereby develop color, and subsequently, a light transmittance adjusting layer and an outermost protective layer which are provided on these layers.

In the present invention, as the compounds contained in the light transmittance adjusting layer, compounds for a precursor of a UV absorbent are disclosed in Japanese Patent Application (JP-A) No. 7-276808 (pp. 11 to 15).

The aforementioned compounds do not absorb light for fixing images when a heat-sensitive recording material is fixed. After forming images, the compounds absorb UV having a longer wavelength by the heat-sensitive recording material being irradiated with light. Accordingly, the light stability of the images can be improved.

In a manner similar to the above-described method of producing color-developing compounds, the compounds may be used in any of the following methods, (1) solid-dispersing, (2) emulsifying, (3) polymer-dispersing, (4) latex-dispersing, and (5) encapsulating in microcapsules. Among these, the method of encapsulating the compounds in microcapsules is preferable.

The compound is contained in a protective layer, and the protective layer can act as a light transmittance adjusting layer at the same time. Further, separately from the protective layer, a light transmittance adjusting layer containing the compound therein can be provided. When a protective layer or a light transmittance adjusting layer is formed, the coating amount of the compound is preferably more than or equal to 0.35 $g/m^2$, and more preferably, 0.35 to 1.5 $g/m^2$. In this case, if the coating amount is less than 0.35 $g/m^2$, the light transmitting function, and in particular, the reduction of the rate of light transmission after the irradiation of light having the necessary wavelength range to fix images, becomes a problem leading to a reduction in light-fastness. On the other hand, if the coating amount exceeds 1.5 $g/m^2$, the light transmitting function, and in -particular, the rate of light transmission before the irradiation of light having the necessary wavelength to fix images, tends to decrease leading to detects in the fixing.

The above-described compounds can be emulsion dispersed or encapsulated in microcapsules in a manner similar to the above-described method for color-developing compound.

In the present invention, in order to more effectively prevent coloration of background when the image fades, known compounds as a reductant can be used together with a precursor of the aforementioned UV absorbent. During use of a microcapsule, the reductant can be contained inside or outside of the microcapsule. When the reductant is provided outside of the microcapsule, then, during thermal printing, the reductant enters into the microcapsule. Examples of these additives include hydroquinone compounds, hydrazide compounds, hydroxy compounds, phenidone compounds, catechol compounds, resorcinol compounds, hydroxyhydroquinone compounds, pyrrologlycinol compounds, phenol compounds, phenylhydrazide compounds, gallic acid compounds, ascorbic acid compounds, and ethyleneglycol compounds. These additives are disclosed in Japanese Patent Application Laid-Open (JP-A) Nos. 3-191341, 3-25434, 1-252953, 2-302753, 1-129247, 1-227145, 1-243048, and 2-262649. Specific examples of these include N-phenylacetohydrazide, N-phenylbutyrylhydrazide, p-t-butyrilphenol, and 2-adidobenzoxazol.

It is also effective to use various additives which are already known as a heat-sensitive recording material and a pressure-sensitive recording material for the heat-sensitive recording layer of the present invention. These antioxidants are partially disclosed in Japanese Patent Application Laid-Open (JP-A) Nos. 60-125470, 60-125471, 60-125472, 60-287485, 60-287486, 60-287487, 62-146680, 60-287488, 62-282885, 63-89877, 63-88380, 63-088381, 01-239282, 04-291685, 04-291685, 04-291684, 05-188687, 05-188686, 05-110490, 05-1108437, 05-170361, 63-203372, 63-224989, 63-267594, 63-182484, 60-107384, 60-107383, 61-160287, 61-185483, 61-211079, 63-251282, 63-051174, 48-043294, and 48-033212.

Specific examples of these include 6-ethoxy-1-phenyl-2,2,4-trimethyl-1,2-dihydroquinoline, 6-ethoxy-1-octyl-2,2,4-trimethyl-1,2-dihydroquinoline, 6-ethoxy-1-phenyl-2,2,4-trimethyl-1,2,3,4-tetrahydroquinoline, 6-ethoxy-1-octyl-2,2,4-trimethyl-1,2,3,4-tetrahydroquinoline, nickel cyclohexanate, 2,2-bis-4-hydroxyphenylpropane, 1,1-bis-4-hydroxyphenyl-2-ethylhexane, 2-methyl-4-methoxydiphenylamine, 1-methyl-2-phenylindole or the below listed compounds.

Q-29

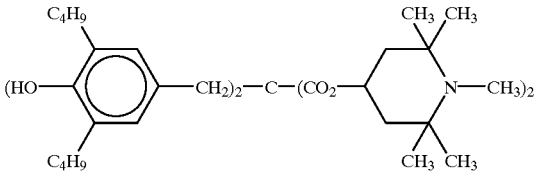

Q-30

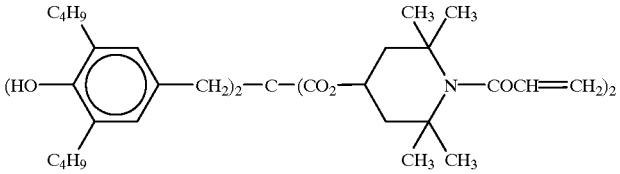

Q-31

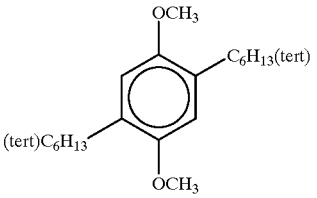

Q-32

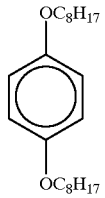

Q-33

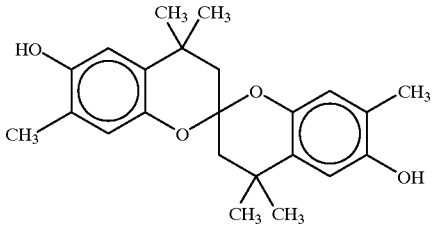

Q-34

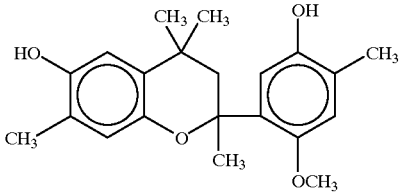

-continued
Q-35
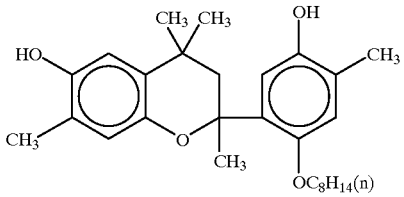
Q-36
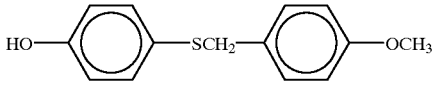
Q-37
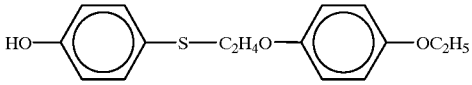
Q-38
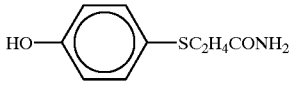
Q-39
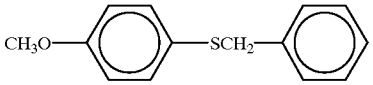
Q-40
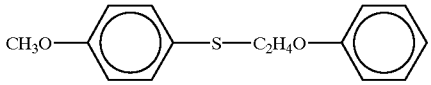
Q-41
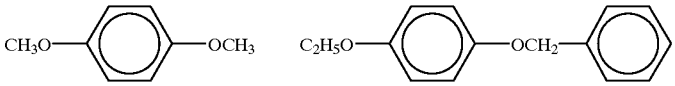
Q-42
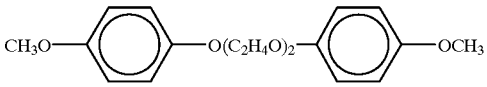
Q-43
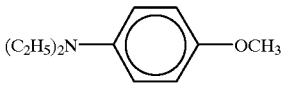
Q-44
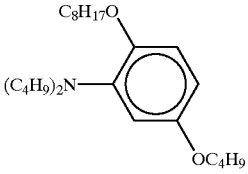
Q-45
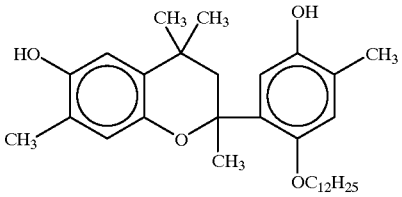
and
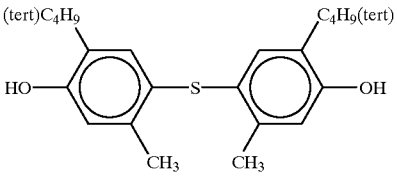
are used in combination.
Q-46
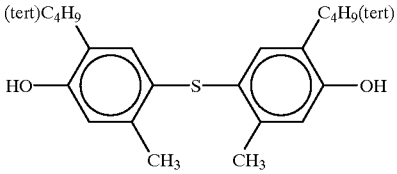
and hydroqino ether are used in combination.
Q-47
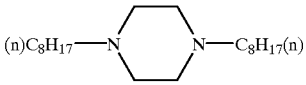
Q-48
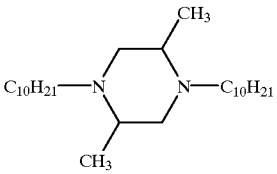

-continued
Q-49
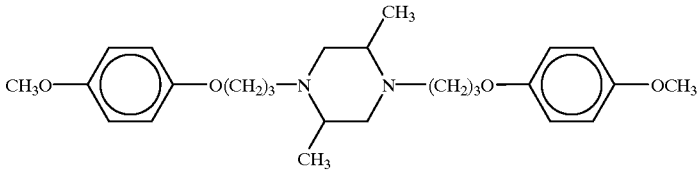
Q-50
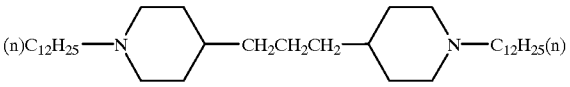
Q-51
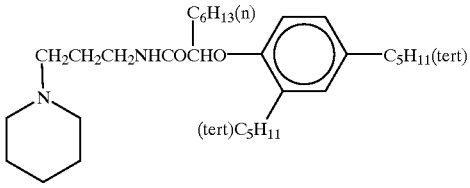
Q-52
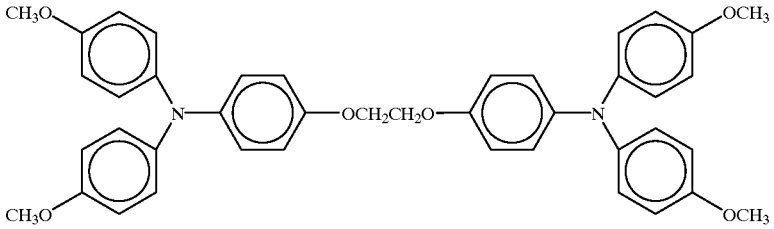
Q-53
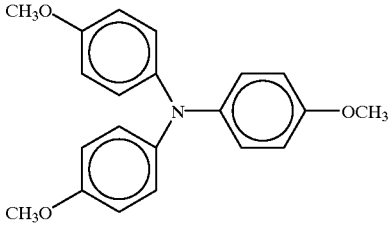
Q-54
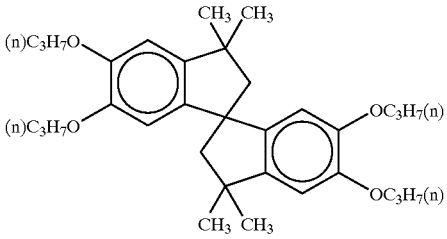
Q-55
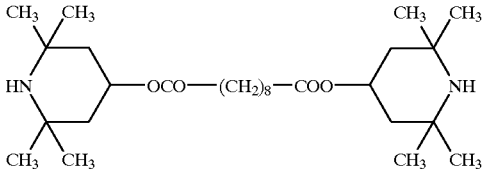
Q-56
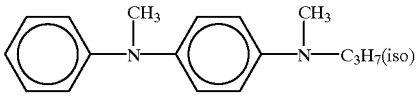
Q-57
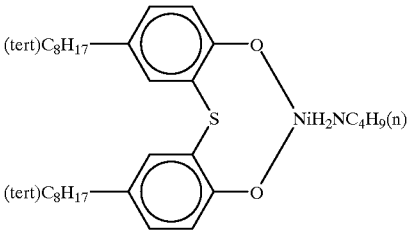

-continued

Q-58

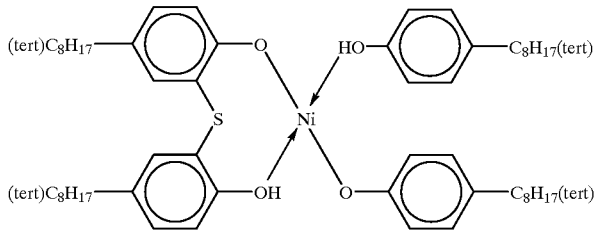

These antioxidants can be added to a heat-sensitive recording layer or an intermediate layer, a light transmittance adjusting layer, or a protective layer. Examples of these antioxidants used in combination include Examples (Q-7), (Q-45), (Q-46) or the compound (Q-10) and the compound (Q-13).

As the support used in the present invention, plastic film, paper, plastic resin laminated paper, synthetic paper, or the like can be used.

In the present invention, if heat-sensitive recording layers having different hues are laminated, it is possible to provide an intermediate layer between the heat-sensitive recording layers in order to prevent color mixing. If paper such as laminating paper having a high transmittance of $O_2$ are used as a support, it is possible to use an undercoat layer as an $O_2$ block layer in order to improve light-fastness. A water-soluble high polymer compound is used for an intermediate layer or an undercoat layer. Examples of these compounds include polyvinylalcohol, denaturated polyvinylalcohol, methylcellulose, polystyrenesulfonic acid sodium, styrene-maleic acid copolymer, and gelatin.

In order to prevent color mixing or to improve light-fastness or in a particularly thin intermediate layer or undercoat layer, it is effective to contain therein a swelling inorganic layer compound which is disclosed in Japanese Patent Application (JP-A) No. 8-282112.

In the present invention, for the purpose of providing glossiness, a protective layer can provide sufficient frictional resistance and lubrication properties without containing an organic or inorganic pigment. However, it depends on the purpose of use of the present invention as to whether all general organic or inorganic pigments can be used. Specific examples of these pigments include calcium carbonate, aluminium hydroxide, barium sulfate, titanium oxide, talc, agalmatolite, kaoline, sintered kaoline, amorphous silica, urea formalin resin powder, polyethylene resin powder, and benzoguanamine resin particles. These pigments are used singly or in combinations of two or more.

In addition to polyvinyl alcohol, and a wall film forming polymer such as a silicone denaturated polymer disclosed in Japanese Patent Application (JP-A) No. 9-83052, the protective layer coating solution of the present invention may use as needed a dispersing solution of the aforementioned pigments, a cross linking agent, a catalyst, a mold releasing agent, a surfactant, a wax, and a water repellent agent. The obtained protective layer coating solution is coated and dried on a heat-sensitive recording layer by a bar coater, an air knife coater, a blade coater, and a curtain coater so that the protective layer of the present invention can be provided. However, it does not matter if the protective layer is coated at the same time as the heat-sensitive recording layer or if the heat-sensitive recording layer is coated, dried and then coated with the coating solution. However, the dried coating amount of the protective layer preferably ranges from 0.1 to 3 g/m$^2$, and more preferably from 0.3 to 1.5 g/m$^2$. If the coating amount is excessive, heat sensitivity deteriorates greatly. If the coating amount is too small, the protective layer cannot exhibit the original properties as a protective layer (e.g., friction resistance, lubricity, abrasion resistance, or the like). After the protective layer was coated, as needed, a calender process can be applied to the resultant protective layer.

In the above-described examples, a description especially for a fullcolor heat-sensitive recording layer has been given. However, the present invention can be applied to a monocolor heat-sensitive recording layer.

The present invention will next be described by way of examples, which should not be construed as limiting the invention.

EXAMPLES

Comparative Example 1

[Preparation of a heat-sensitive recording layer solution]

Preparation of diazonium salt compound-containing capsule solution

A diazonium salt compound (a-1) having a spectroscopy maximum absorption wavelength of 365 nm (2.8 parts by weight), dibutyl sulfate (2.8 parts by weight), and 2,2-dimethoxy-1,2-diphenylethane-1-on (Illgaqua 651 manufactured by Ciba-Geigi Co., Ltd.) (0.56 parts by weight) were dissolved in ethyl acetate (19.0 parts by weight). A high boiling point solvent, i.e., isopropylbiphenyl (5.9 parts by weight) and tricresyl phosphate (2.5 parts by weight) were added to the previous solution, and mixed uniformly by heating. An adduct of xylylenediisocyanate/trimethylolpropane (75% ethyl acetate solution, TAKENATE D-11ON manufactured by Takeda Chemical Industries, Ltd.) (7.6 parts by weight) was added to the resultant mixture as a capsule wall agent and stirred uniformly. Next, a separate aqueous solution (64 parts by weight) of a 6 wt. % gelatin (MGP-9066 manufactured by Nippi Gelatine Kogyo Co., Ltd.) and a 10 wt. % aqueous sodium dodecylsulfonate solution (2.0 parts by weight) was prepared. The aforementioned diazonium salt compound solution was added to this solution, and the resultant mixture was emulsified by a homogenizer. To the obtained emulsion, water (20 parts by weight) was added and homogenized. Thereafter, the resultant mixture was stirred and heated for 3 hours to a temperature of 40° C. to thereby perform an encapsulation reaction. Thereafter, the obtained mixture was cooled to a temperature of 35° C. Ion exchange resin amberlite IRA 68 (manufactured by Organo Inc.) (6.5 parts by weight) and amberlite $IRC_{50}$ (manufactured by Organo Inc.) (13 parts by weight) were added to the resultant mixture, which was stirred for another hour. Thereafter, the ion exchange resin was filtered, thereby obtaining the desired capsule solution. The mean diameter of the capsules was 0.64 $\mu$m.

a-1

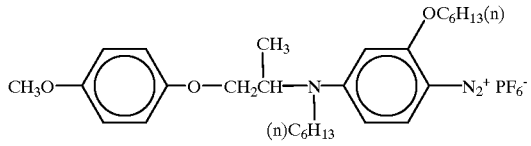

Preparation of coupler emulsion

In ethyl acetate (10.5 parts by weight) were dissolved a compound (b-1) described hereinbelow as a coupler (3.0 parts by weight) described hereinbelow, triphenylguanidine (4.0 parts by weight), 1,1-(p-hydroxyphenyl)-2-ethylhexane (4.0 parts by weight), 4,4'-(p-phenylenediisopropylidene) diphenol (8.0 parts by weight), 2-ethylhexyl-4-hydroxybenzoate (8.0 parts by weight), a compound (b-2) as an antioxidant (2.0 parts by weight), 1,1,3-tris (2-methyl-4-hydroxy-5-t-butylphenyl) butane (2.0 parts by weight). Further, high boiling point solvents, i.e., tricresyl phosphate (0.48 parts by weight), diethyl maleate (0.24 parts by weight), and pionin A41C (manufactured by Takemoto Oil Co., Ltd.) (1.27 parts by weight) were added to the resultant solution. Thereafter, the solution was uniformly mixed by heating. Next, the resultant solution and a separate 8 wt. % aqueous gelatin solution (#750 gelatin manufactured by Nitta Gelatin Co., Ltd.) (93 parts by weight) were mixed and emulsified by a homogenizer. Residual ethyl acetate was evaporated from this emulsion., thereby obtaining an emulsion-dispersed solution.

Preparation of coating solution

While dissolving and stirring the above-prepared diazonium salt compound capsule solution at a temperature of 40° C., a core/shell type latex which comprises a core portion of styrene butadiene copolymer (37:63) and a shell portion of styrene 2-acetoacetoxyethylmethacrylate copolymer (87:16) and in which the ratio of the core portion to the shell portion is equal to 50:50 was added to the diazonium salt compound capsule solution such that the ratio of diazonium salt compound to latex solid matter is 1:6.4. Further, to the resultant mixture, a coupler emulsion which was dissolved at a temperature of 40° C. was added such that the ratio of diazonium salt compound to coupler was 1:2, thereby preparing a coating solution 101 (comparative example).

b-1

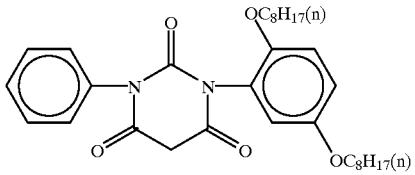

b-2

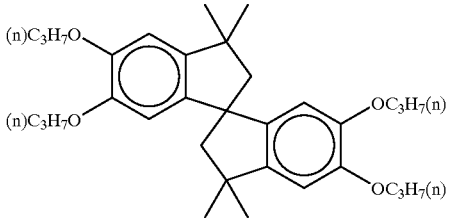

Comparative Example 2

A coating solution 102 (comparative example) was prepared in a manner similar to the comparative example 1 except that the core/shell type latex was not added.

Example 1

A coating solution 103 was prepared in a manner similar to the comparative example 1 except that 10 wt. % aqueous solution of the compound (P-22) which was listed as an example of a compound represented by the aforementioned formula (I) and the diazonium salt compound capsule solution were mixed previously such that the ratio of a capsule solid matter to the compound (P-22) was 1:0.1.

Example 2

A coating solution 104 was prepared in exactly the same manner as the comparative example 1 except that 10 wt. % of aqueous solution of the compound (P-22) as an example of the compound represented by the formula (I) and the core/shell type latex were previously mixed such that the ratio of latex solid matter to the compound (P-22) was 1:0.1.

Example 3

A coating solution 105 was prepared in exactly the same manner as the comparative example 1 except that a 10 wt. % of aqueous solution of the compound (P-22) as an example of the compound represented by the aforementioned formula (I) was added to the capsule and the latex, respectively in such an amount that solid matter was added in an amount of 10 wt. %, and then stirred.

Example 4:

A coating solution 106 was prepared in exactly the same manner as the comparative example 1 except that 10 wt. % aqueous solution of the compound (P-22) as an example of the compound represented by the aforementioned formula (I) and the diazonium salt compound capsule solution were mixed previously such that the ratio of capsule solid matter to the compound (P-22) was 1:0.1.

After the coating solution thus prepared was stirred for an hour in a thermostatic oven at a temperature of 40° C., the particle diameter distribution, the mean particle diameter, and the maximum particle diameter of capsules were measured by a dispersed particle distribution laser analyzing apparatus, LA700 (manufactured by Horiba Seisakusho). The results are shown in Table 5.

TABLE 5

| Coating solution No. | Mean particle diameter (μm) | Maximum particle diameter (μm) |
|---|---|---|
| Com. Example 101 | 16.5 | 59 |
| Com. Example 102 | 1.95 | 4.86 |
| Pres. Invention 103 | 0.98 | 1.90 |
| Pres. Invention 104 | 1.06 | 2.68 |
| Pres. Invention 105 | 0.86 | 1.58 |
| Pres. Invention 106 | 0.70 | |

Example 5

Preparation of protective layer coating solution

| | |
|---|---|
| RS110 (10 wt. %) | 100 g |
| water | 50 g |
| X-22-8053 (40 wt. %) | 10 g |
| surfactant-1 (2 wt. %) | 5 ml |
| surfactant-2 (5 wt. %) | 5 ml |

were mixed and uniformly stirred, to thereby obtain a protective layer coating solution.

However, a polymer RS110 was a PVA derivative (manufactured by Kuraray Co., Ltd.).

Further, X-22-8053 is a silicone graft acryl polymer (Tg=110° C.) (manufactured by Shinetsu Chemical Co., Ltd.) having the molecular structure described below.

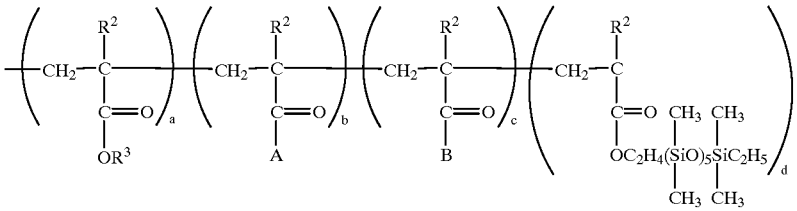

$R^2$ : H, $CH_3$
$R^3$ : alkyl group
A : hydrophobic group
B : reactive group

Surfactant-1 and surfactant-2 have the below-described structural formulas.

Surfactant-1

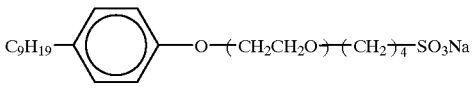

Surfactant-2

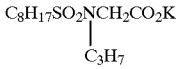

Preparation of light transmittance adjusting layer coating solution

A compound UVP-(1) (1.5 parts by weight) and a compound R-6 as a reductant (0.5 parts by weight) and ethyl acetate (6.0 parts by weight) and tricresyl phosphate (0.8 parts by weight) were mixed and dissolved sufficiently. To the resultant solution were added xylylenediisocyanate/trimethylolpropane (75% ethyl acetate solution, TAKENATE D-11ON manufactured by Takeda Chemical Industries, Ltd.) (3.0 parts by weight) as a capsule wall agent, and the resultant mixture was uniformly stirred. 8 wt. % of aqueous carboxy denaturated polyvinylalcohol solution KL-318 (manufactured by Kuraray Co., Ltd.) (29.7 parts by weight) was added to the former solution. The resultant mixture was emulsion dispersed by a homogenizer. The resultant emulsion was added to ion exchange water (490 parts by weight) and stirred for three hours at a temperature of 40° C. to hereby perform an encapsulation reaction. Thereafter, to the resultant solution was added ion exchange resin amberlite MB-03 (manufactured by Organo Co., Ltd.) (7.0 parts by weight). The resultant mixture was stirred for another hour. In this way, a light transmittance adjusting layer coating solution was obtained. The mean particle diameter of capsules was 0.35 $\mu$m.

UVC-1

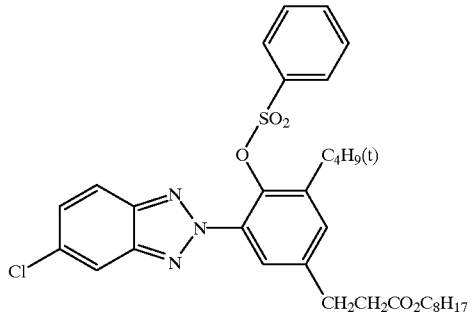

R-6

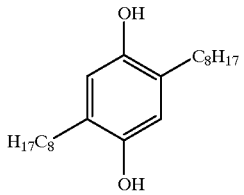

Manufacturing of a support

A wooden pulp comprising LBKP (100 parts by weight) was beaten by a double disk refiner to obtain a Canadian freeness standard of 300 cc or less. To the obtained pulp were added epoxy behenic acid amide (0.5 parts by weight), anionpolyacryl amide (1.0 parts by weight), polyamide-polyamine picloro hydrine (0.1 parts by weight), polyamide-polyamine epychloro hydrine (0.1 parts by weight), and cationpolyacrylamide (0.5 parts by weight) at an absolute dry weight ratio. Untreated paper was made at a basis weight of 100 g/$m^2$ by using an elongated steel paper machine. The surface of the resultant untreated paper was sized by polyvinyl alcohol at an absolute dry weight ratio of 1.0 g/$m^2$ and was subjected to a calender process so as to obtain a density of 1.0.

After the wire surface (rear surface) of the untreated paper thus obtained was subjected to a corona discharge process, the untreated paper was coated with high density polyethylene by a melting extruder so as to form a resin layer which was formed by a matt surface and which had a thickness of 30 $\mu$nm (this surface is called a "rear surface"). After the polyethylene coated surface of this rear surface was subjected to a corona discharge process, as an antistatic agent, aluminum oxide (Aluminazol 100 manufactured by Nissan Chemical Kogyou Co., Ltd.) and silicon dioxide (Snowtex 0 manufactured by Nissan Chemical Kogyou Co., Ltd.) were dispersed in water at a weight ratio of 1:2, and the solution thus obtained was coated on the layer in a dried amount of 0.2 g/m$^2$ (this is called a rear laminated PE product).

After the felt surface (top surface) of the untreated paper was subjected to a corona discharge process, the untreated paper was coated with low density polyethylene which contains 10 wt. % of titanium dioxide and a micro amount of ultramarine blue by a melting extruder so as to form a resin layer which was formed by a glossy surface and which has a thickness of 40 $\mu$m (this surface is called a "top surface"). After the polyethylene coated surface of the top surface of the resin layer was subjected to a corona discharge process, and the resin layer was coated with a gelatin undercoat solution in a dried amount of 0.1 g/m$^2$.

Preparation of heat-sensitive recording material

The above-prepared coating solutions 101 to 106 in the Comparative Examples 1 and 2, and Examples 1 to 4 were respectively applied to the support -by a wire bar in such a manner that solid matter was spread in an amount of 8 g/cm$^2$. Further, the light transmittance adjusting layer and the protective layer were subsequently applied to these layers in the amounts of 2.5 g/cm$^2$ and 1.25 g/cm$^2$, respectively, thereby manufacturing heat-sensitive recording materials 101 to 106.

A voltage to be applied and a pulse width for a thermal head, model KST (manufactured by Kyocera Corp.), were determined so as to obtain a recording energy per unit area of 62 mJ/mm$^2$. The thus determined power was applied to print the heat-sensitive recording material, thereby forming a magenta image. Then, the heat-sensitive recording material was exposed for 15 seconds to an ultraviolet lamp which emits light having a center wavelength of 365 nm and has an output of 40 W, thereby fixing the image.

(Evaluation)

Glossiness was measured by a digital variable angle glossmeter UGV-50 (manufactured by Suga testing machine Co., Ltd.) at an incident angle of 75°.

Graininess of the image was evaluated in steps A to C by a visual evaluation.

A: uniform image

B: noticeable graininess

C: extremely rough graininess

The results of the evaluation are shown in Table 6.

TABLE 6

| Heat-sensitive recording material | Glossiness | Graininess |
|---|---|---|
| 101 (Comparative Example) | 8.5 | C |
| 102 (Comparative Example) | 15.3 | B |
| 103 (Present Invention) | 50.3 | A |
| 104 (Present Invention) | 48.0 | A |
| 105 (Present Invention) | 56.3 | A |
| 106 (Present Invention) | 62.2 | A |

As is evident from Table 6, any of the heat-sensitive recording materials according to the present invention has excellent glossiness and uniform graininess so that an excellent image was obtained.

Example 6, Comparative Example 3

(1) Preparation of a cyan heat-sensitive recording layer solution:

(Preparation of a capsule solution which contains an electron donative dye precursor)

1. Solution A

After 3-(o-methyl-p-dimethylaminophenyl)-3-(1'-ethyl-2'-methylindol-3-yl) phthalide (electron donative dye precursor) (5 parts by weight) was dissolved in ethyl acetate (20 parts by weight), to the resultant mixture was added alkylnaphthalene (high boiling point solution) (20 parts by weight), heated and uniformly mixed.

To the thus obtained solution was added 1:3 adduct of xylylene diisocyanate/trimethylolpropane (20 parts by weight). The resultant mixture was homogeneously stirred, providing solution A.

2. Solution B

A 6 wt. % aqueous phthalic gelatin solution (54 parts by weight) and a 2% aqueous sodium dodecyl sulfonate solution (2 parts by weight) were mixed, preparing a solution B.

Solution A was added to solution B. The resultant mixture was emulsion dispersed through use of an homogenizer. The obtained emulsion and water (68 parts by weight) were uniformly mixed. The resultant mixture was heated to a temperature of 50° C. while being stirred, followed by an encapsulation reaction performed for 3 hours so as to obtain a capsule solution having a mean microcapsule diameter of 1.2 $\mu$m.

(Preparation of a developer emulsion dispersion)

1,1-(p-hydroxyphenyl)-2-ethylhexane (developer) (2.5 parts by weight), tricresylphosphate (0.3 parts by weight), and diethyl maleate (0.1 parts by weight) were dissolved in ethyl acetate (10 parts by weight). The resultant solution was added to a mixed aqueous solution of a 6 wt. % aqueous gelatin solution (20 parts by weight) and a 2 wt. % aqueous sodium dodecylbenzenesulfonate solution (2 parts by weight). The resultant mixture was emulsified for 10 minutes through use of a homogenizer, to thereby obtain an emulsion dispersion.

(Preparation of a coating solution)

A 10% aqueous solution of the compound (P-37) as an example of the compound represented by the formula (I) was added to the above-prepared capsule solution which contains an electron donative dye precursor in such a manner that the weight ratio of capsule solid matter to the compound (P-37) was 1:0.1. The developer emulsion dispersion, and the capsule solution, which contained an electron donative dye precursor were mixed at a weight ratio of 1:4, to thereby obtain a coating solution for Example 201.

As a comparative example, a coating solution for Comparative Example 202 was obtained in a manner similar to Example 201 except that the compound (P-307) was not added.

(2) Preparation of a magenta heat-sensitive recording layer solution (Preparation of a capsule solution containing a diazo compound)

A diazo compound-(1) represented by the structural formula described below (which is decomposed by light having a wavelength of 365 nm) (2.0 parts by weight) was dissolved in ethyl acetate (20 parts by weight). To the resultant solution was added alkylnaphthalene (20 parts by weight). The resultant mixture was uniformly mixed with heating. The obtained solution and 1:3 adduct of xylylene diisocyanate/trimethylolpropane (15 parts by weight) used as the capsule wall agent, were uniformly mixed to thereby obtain a diazo compound solution.

The obtained diazo compound was added to a mixed solution of a 6% aqueous phthalic gelatin solution (54 parts by weight) and a 2% aqueous sodium dodecylsulfonate solution (2 parts by weight). The resultant mixture was emulsion dispersed through use of a homogenizer.

The obtained emulsion and water (68 parts by weight) were uniformly mixed. The resultant mixture was heated to a temperature of 40° C. while being stirred, followed by an encapsulation reaction performed for 3 hours so as to obtain a mean microcapsule diameter of 1.2 μm, thereby providing a capsule solution.

Diazo compound-(1)

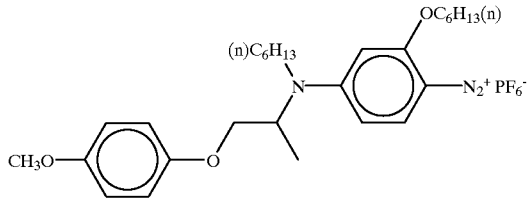

(Preparation of a coupler emulsion dispersion)

A coupler (1) represented by the below-described structural formula (2 parts by weight), 1,2,3-triphenylguanidine (2 parts by weight), tricresylphosphate (0.3 parts by weight), and diethyl maleate (0.1 parts by weight) were dissolved in ethyl acetate (10 parts by weight). The obtained solution was added to a mixed aqueous solution of a 6% aqueous gelatin solution (20 parts by weight) and a 2% aqueous sodium dodecylsulfonate solution (2 parts by weight). The resultant mixture was emulsified for 10 minutes through use of a homogenizer, to thereby provide an emulsion dispersion.

Coupler (1)

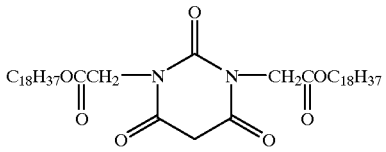

(Preparation of a coating solution)

A 10% aqueous solution of the compound (P-37) as an example of a compound represented by the general formula (I) was added to the above-prepared capsule solution, which contained a diazo compound in such a manner that the weight ratio of solid matter of the capsule solution to the compound (P-37) is 1:0.1. The capsule solution which contained a diazo compound, and the coupler emulsion were mixed at a weight ratio of 3:2, to thereby obtain a coating solution for Example 201.

Further, a coating solution for Comparative Example 202 was obtained in a manner similar to Example 201 except that the compound (P-37) was not added to the capsule solution.

(3) Preparation of a yellow heat-sensitive recording layer solution (Preparation of a capsule solution containing a diazo compound)

2,5-dibutoxy-4-tolylthiobenzene diazonium hexafluorophosphate (a diazo compound which is decomposed by light having a wavelength of 420 nm) (3.0 parts by weight) was dissolved in ethyl acetate (20 parts by weight). To the resultant solution was added alkylnaphthalen (20 parts by weight) as a high boiling point solvent. The resultant mixture was uniformly mixed with heating.

The obtained solution and 1:3 adduct of xylylene diisocyanate/trimethylolpropane (15 parts by weight) used as the material for the capsule wall, were uniformly mixed to thereby provide a diazo compound solution.

The obtained diazo compound solution was added to a mixed solution of a 6% aqueous phthalic gelatin solution (54 parts by weight) and an aqueous sodium dodecylsulfonate solution (2 parts by weight). The resultant mixture was emulsion dispersed through use of a homogenizer. The obtained emulsion dispersion and water (68 parts by weight) were uniformly mixed. The resultant mixture was heated to a temperature of 40° C. while being stirred, followed by an encapsulation reaction performed for 3 hours so as to obtain a mean microcapsule diameter of 1.3 μm, thereby obtaining a capsule solution.

(Preparation of a coupler emulsion dispersion)

2-chloro-5-(3-(2,4-di-tert-pentyl)phenoxypropyl amino) acetanilide (2 parts by weight), 1,2,3-triphenylguanidine (1 parts by weight), tricresyl phosphate (0.3 parts by weight) and diethyl maleate (0.1 parts by weight) were dissolved in ethyl acetate (10 parts by weight). The resultant solution was added to a mixed aqueous solution of a 6% aqueous gelatin solution (20 parts by weight) and a 2% aqueous sodium dodecylsulfonate solution (2 parts by weight). The resultant mixture was emulsified for 10 minutes through use of a homogenizer, to thereby obtain an emulsion dispersion.

(Preparation of a coating solution)

A 10% aqueous solution of the compound (P-37) as an example of a compound represented by the formula (I) was added to the above-prepared capsule solution, which contains a diazo compound, in such a manner that a weight ratio of solid matter of the capsule solution to the compound (P-37) was 1:0.1. The capsule solution which contains a diazo compound, and the coupler emulsion were mixed at a weight ratio of 3:2, to thereby obtain a coating solution for Example-201.

Further, a coating solution for Comparative Example-202 was obtained in a manner similar to Example-201 except that the compound (P-37) was not added to a capsule solution.

(4) Preparation of an intermediate coating solution

A 15 wt. % aqueous gelatin solution (#750 manufactured by Nitta Gelatin Co., Ltd.) (10 parts by weight) and a 15 wt. % aqueous acrylic acid solution (JulymerAC-10L manufactured by Japan Pure Medicine Co., Ltd.) (3 parts by weight) were uniformly mixed, to thereby obtain an intermediate layer coating solution.

(5) Preparation of a light transmittance adjusting coating solution

A compound represented in Example (23) (1.5 parts by weight) and a reductant R-6 (0.5 parts by weight), and ethyl acetate (6.0 parts by weight) and tricresyl phosphate (0.8 parts by weight) were mixed and sufficiently dissolved. To the obtained solution was added an adduct of xylylenediisocyanate/trimethylolpropane (a 75% ethyl acetate solution, TAKENATE D-110N manufactured by Takeda Chemical Industries, Ltd.) (3.0 parts by weight) used as the material for the capsule wall. The resultant mixture was uniformly stirred. An 8% aqueous solution of carboxy denaturated polyvinyl alcohol (KL-318 manufactured by Kuraray Co., Ltd.) (29.7 parts by weight) was prepared, and added to the above-prepared solution. The resultant mixture was emulsified through the use of a homogenizer. The thus obtained emulsion and ion exchange water were mixed. The resultant mixture was stirred and heated for 3 hours to a temperature of 40° C. to thereby perform an encapsulation reaction. To the resultant emulsion was added ion exchange resin amberlite MB-03 (7.0 parts by weight) (manufactured by Organo Inc.). The resultant mixture was stirred for another 1 hour, obtaining a desired light transmittance adjusting layer coating solution. The mean diameter of the capsules was 0.35 μm.

| (6) Preparation of a protective layer solution | |
|---|---|
| RS 106 (10 wt. %) | 100 g |
| Water | 50 g |
| X-22-8053 (40 wt. %) | 10 g |
| Surfactant-1 | 5 ml |
| Surfactant-2 | 5 ml |

were mixed and homogeneously stirred, to obtain a protective layer coating solution.

However, the polymer RS 106 was a PV derivative (manufactured by Kuraray Co., Ltd.)

(7) Preparation of an undercoat layer solution

A swelling synthetic mica ME100 (manufactured by Corp Chemical Inc.) (2.5 parts by weight) and water (97.5 parts by weight) were mixed and dispersed by a dynamill. The resultant solution was added to a 5 wt. % aqueous gelatin solution (200 g) at a temperature of 40° C. and stirred for 30 minutes. To the resultant mixture was added the above-described 5% surfactant-1 (20 cc), to thereby obtain an undercoat layer solution.

(8) Preparation of a heat-sensitive recording material

An undercoat layer solution, a cyan heat-sensitive recording layer solution, an intermediate layer solution, a magenta heat-sensitive recording layer solution, an intermediate layer solution, a yellow heat-sensitive recording layer solution, a light transmittance adjusting layer solution and a protective layer solution were coated on the aforementioned polyethylene laminated paper support which was prepared in Example 5, in this order. After drying, the multicolor heat-sensitive recording materials 201 and 202 for Example 6 and Comparative Example 3 were obtained.

Each of these coating solutions was applied in such an amount that solid matter was spread in the following dried amounts: in the order from the support, undercoat layer 1 g/m$^2$; cyan heat-sensitive recording layer 6.1 g/m$^2$; intermediate layer 1.0 g/m$^2$; magenta heat-sensitive recording layer 7.8 g/m$^2$; intermediate layer 1.0 g/m$^2$; yellow heat-sensitive recording layer 7.2 g/m$^2$; light transmittance adjusting layer 1.5 g/m$^2$; and protective layer 1.0 g/m$^2$, to thereby obtain a sample described in Table 7 (a full color heat-sensitive recording material).

A thermal recording was applied to the thus formed full color heat-sensitive recording material. Glossiness in the gray portion whose B/W density is approximately 0.7 was evaluated. The results are shown in Table 7.

TABLE 7

| Heat-sensitive recording material | Glossiness (incident angle = 75°) |
|---|---|
| 201 (Present Invention) | 71.8° |
| 202 (Comparative Example) | 38.5° |

As is evident from Table 7, a full color heat-sensitive recording material of the present invention had excellent glossiness.

In accordance with the heat-sensitive recording material of the present invention, since the dispersion stability of a color-developing compound or a film improving compound contained in the heat-sensitive recording material can be improved, there is provided an excellent effect that an image having uniform image quality, excellent transparency and glossiness can be formed with high color-developing sensitivity through imagewise heating, using a thermal head or an infrared laser.

What is claimed is:

1. A heat-sensitive recording material comprising in sequence a support, a heat-sensitive recording layer which is provided on the support and contains at least two types of compound which react with each other to develop color by heating imagewise, and a protective layer, wherein at least one of the layers contains the compound represented by the following formula (I):

$$R—(S—P)_n \qquad \text{Formula (I)}$$

wherein R represents a hydrophobic group or a hydrophobic polymer, P represents a polymer including at least one of the below-described structural units A, B, and C, and having a polymerization degree which ranges from 10 to 3500, and n represents 1 or 2,

A:

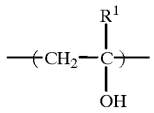

B:

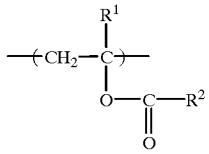

C:

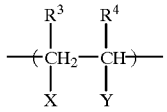

wherein $R^1$ represents —H or an alkyl group having 1 to 6 carbon atoms, $R^2$represents —H or an alkyl group having 1 to 10 carbon atoms, $R^3$ represents —H or —$CH_3$, $R^4$ represents H, —$CH_3$, —$CH_2COOH$ or an ammonium salt thereof or a metallic salt thereof or —CN, X represents —H, —COOH or an ammonium salt thereof or a metallic salt thereof or —$CONH_2$, and Y represents —COOH or an ammonium salt thereof or a metallic salt thereof, —$SO_3H$ or an ammonium salt thereof or a metallic salt thereof, —$OSO_3H$ or an ammonium salt thereof or a metallic salt thereof, —$CH_2SO_3H$ or an ammonium salt thereof or a metallic salt thereof, —$CONHC(CH_3)_2CH_2SO_3H$ or an ammonium salt thereof or a metallic salt thereof or —$CONHCH_2CH_2CH_2N^+(CH_3)_3C^-$.

2. A heat-sensitive recording material according to claim 1, wherein at least one of the types of compound which react with each other through said application of heating to thereby develop color is encapsulated in a microcapsule, and at least a layer containing the microcapsule contains the compound represented by the formula (I).

3. A heat-sensitive recording material according to claim 1, wherein at least one of the heat-sensitive recording layer and layers adjacent to said heat-sensitive recording layer contains the compound represented by the formula (I) and a latex dispersing solution.

4. A heat-sensitive recording material according to claim 1, having, as said heat-sensitive recording layer, at least a heat-sensitive recording layer which mainly contains a diazo compound, a coupler which reacts with the diazo compound to perform a coupling reaction and develop color, and a binder, and in which the diazo compound is encapsulated in a microcapsule.

5. A heat-sensitive recording material according to claim 1, having, as said heat-sensitive recording layer, at least a heat-sensitive color-developing layer which mainly contains an electron donative dye precursor and an electron acceptive compound, wherein at least one of the electron donative dye precursor and the electron acceptive compound is encapsulated in a microcapsule.

6. A heat-sensitive recording material according to claim 1, having, as said heat-sensitive recording layer, at least one of a heat-sensitive recording layer which contains an electron donative dye precursor and an electron acceptive compound, and a heat-sensitive recording layer which contains a diazonium salt compound and a coupler which reacts with the diazonium compound to thereby develop color.

7. A heat-sensitive recording material according to claim 1, in which a light transmittance adjusting layer whose light transmittance-in a range of wavelength for light-fixation decreases after fixation is provided on said heat-sensitive recording layer.

* * * * *